US006045093A

United States Patent [19]

Zheng

[11] Patent Number: 6,045,093

[45] **Date of Patent: *Apr. 4, 2000**

[54] COLLAPSIBLE FLYING STRUCTURES

[75] Inventor: Yu Zheng, Covina, Calif.

[73] Assignee: Patent Category Corp., Walnut, Calif.

[ * ] Notice: This patent is subject to a terminal disclaimer.

[21] Appl. No.: 09/118,282

[22] Filed: Jul. 17, 1998

Related U.S. Application Data

[63] Continuation-in-part of application No. 08/908,325, Aug. 7, 1997, Pat. No. 5,901,926.

[51] Int. Cl.[7] ..... B64C 31/06

[52] U.S. Cl. ..... 244/153 R

[58] Field of Search ..... 244/153 R–155 A, 244/13, 16; 446/34, 46, 61, 62, 67; 2/102.1; 135/117, 126, 130, 137; D21/85, 86, 88, 89

[56] References Cited

U.S. PATENT DOCUMENTS

| | | | |
|---|---|---|---|
| 1,092,303 | 4/1914 | Stippick | 244/153 R |
| 2,403,212 | 7/1946 | Concepcion | 244/153 R |
| 3,711,045 | 1/1973 | Holland, Jr. | 244/153 R |
| 3,918,663 | 11/1975 | Cornelison, Jr. | 244/153 R |
| 4,768,739 | 9/1988 | Schnee | 244/153 R |
| 4,815,681 | 3/1989 | Crowell | 244/153 R |
| 4,878,636 | 11/1989 | Mileti | 244/153 R |
| 5,213,289 | 5/1993 | Barresi | 244/153 R |
| 5,560,385 | 10/1996 | Zheng . | |
| 5,579,799 | 12/1996 | Zheng | 135/126 |
| 5,598,988 | 2/1997 | Bukur | 244/153 A |
| 5,657,490 | 8/1997 | Edmark | 244/153 R |
| 5,778,915 | 7/1998 | Zheng . | |
| 5,816,954 | 10/1998 | Zheng . | |

FOREIGN PATENT DOCUMENTS

| | | | |
|---|---|---|---|
| 0261753 | 3/1988 | European Pat. Off. . | |
| 295 04 617 U | 8/1996 | Germany . | |
| 296 14 367 U | 2/1997 | Germany . | |
| 8901362 | of 1990 | Netherlands . | |
| 8901362 | 12/1990 | Netherlands | 244/153 R |
| 569841 | of 1945 | United Kingdom . | |
| 569841 | 6/1945 | United Kingdom | 244/153 R |

*Primary Examiner*—Galen L. Barefoot
*Attorney, Agent, or Firm*—Raymond Sun

[57] ABSTRACT

A collapsible flying structure includes an enclosed resilient frame member having a folded and an unfolded orientation, a sheet material partially covering the resilient frame member to form the flying structure when the frame member is in the unfolded orientation, and a control string coupled to the structure for controlling the flight of the flying structure. The frame member may be twisted and folded to form a plurality of concentric loops in the folded orientation of the frame member to substantially reduce the size of the flying structure.

26 Claims, 20 Drawing Sheets

COLLAPSIBLE FLYING STRUCTURES

RELATED CASES

This is a continuation-in-part of Ser. No. 08/908,325, entitled "Collapsible Flying Structures", filed Aug. 7, 1997, now U.S. Pat. No. 5,901,926, issued May 11, 1999, whose disclosure is incorporated by this reference as though fully set forth herein.

BACKGROUND OF THE INVENTION

1. Field of the Invention

The present invention relates to collapsible structures, and in particular, to collapsible flying structures which may be provided in a variety of shapes and sizes. The collapsible flying structures may be twisted and folded to reduce the overall size of the structures to facilitate convenient storage and use.

2. Description of the Prior Art

Flying kites is a popular past-time that is enjoyed by many, including both adults and children. Kites are being provided in many different shapes and sizes, bearing a large variety of designs and colors. Larger kites are very beautiful when in full flight, and are often admired for their beauty and grace when they flow in the wind. Larger kites are also easier to fly, and can be visible from a further distance. On the other hand, smaller kites are often more difficult to fly, and are less visible than larger kites.

Unfortunately, one problem that is encountered by all kites is that their large size makes them very inconvenient to store, and to transport from one location to another. The irony is that kite-flying is best suited in locations that are relatively open, without many trees, buildings, telephone poles, and other structures and objects that would obstruct the flight of the kite. As a result, most people living in cities will need to carry a large and bulky kite in a vehicle to an open location, which is often outside a metropolitan area. Although some kites have fabric portions that can be folded, the skeleton of the kite which provides structural support and stability is still necessarily large and takes up much space, making them inconvenient to transport in buses or smaller vehicles. In addition, the large size of these kites makes them inconvenient to store in smaller homes where precious storage space is scarce. Thus, the storage and transportion problems associated with the large sizes of conventional kites often deter new potential hobbyists from taking up the hobby, and take away much of the fun and enjoyment from kite-flying enthusiasts.

Thus, there still remains a need for a flying structure, such as a kite, that preserves all the beauty, flight and enjoyment of conventional kites, while providing the hobbyist with convenience in use, storage and transportation. There is also a need for a flying structure, such as a kite, that provides increased variety in use which will enhance the entertainment and recreation value of the flying structure.

SUMMARY OF THE DISCLOSURE

In order to accomplish the objects of the present invention, the collapsible flying structure according to the present invention includes an enclosed resilient frame member having a folded and an unfolded orientation, a sheet material covering the resilient frame member to form the flying structure when the frame member is in the unfolded orientation, and a control string coupled to the structure for controlling the flight of the flying structure. The frame member and sheet material may be twisted and folded to form a plurality of concentric loops and panels in the folded orientation of the frame member to substantially reduce the size of the flying structure.

A frame retaining sleeve may be provided for housing the frame member, with the sheet material attached to the frame retaining sleeve. At least one opening may be defined between the sheet material and the frame retaining sleeve of the frame member. The structure further includes at least one control panel attached to the structure and coupling the control string with the structure.

In one embodiment of the present embodiment, one of the control panels includes an enclosed resilient frame member having a folded and an unfolded orientation, with the control panel substantially covering the resilient frame member when the frame member is in the unfolded orientation.

In another embodiment of the present invention, the flying structure further includes an enclosure attached to the sheet material or frame member, the enclosure having two side walls and a bottom wall attached to the two side walls. The structure further includes at least one opening provided on the sheet material and communicating with the enclosure.

In yet another embodiment of the present invention, the flying structure includes a second structure that also has an enclosed resilient frame member, and a sheet material covering the resilient frame member. The flying structure further includes a connector for connecting the first and second structures. The first structure may be placed on top of the second structure when their frame members are in the unfolded orientation to form a stack of first and second structures, and the frame members of the stack of first and second structures may be twisted and folded to form a plurality of concentric loops in the folded orientation of the frame members to substantially reduce the sizes of the first and second structures. In some embodiments, the connector operates as a hinge to allow the first structure to be folded upon the second structure about the connector. In one embodiment, the connector is detachable so that the first and second structures can be separated. In another embodiment, the connector is a connector piece having a first end attached to the first structure and a second end attached to the second structure. In yet another embodiment, the connector includes a stitching that is applied to the frame retaining sleeves of the first and second panels. In a further embodiment, the connector includes a plurality of threads attaching the frame members or sheet materials of the first and second structures so that a space is defined between the first and second structures when the flying structure is in use.

In a further embodiment of the present invention, the flying structure further includes a third structure that also has an enclosed resilient frame member, a sheet material covering the resilient frame member, a first side and a second side. The first side of the third structure is coupled to the sheet material of the first structure, and the second side of the third structure is coupled to the sheet material of the second structure. The third structure may be positioned generally perpendicular to the first and second structures. In addition, at least one of the first and second sides may be removably attached to the sheet material of one of the first structure or the second structure.

In a further embodiment of the present invention, the flying structure has at least first, second and third structures, each having an enclosed resilient frame member, a sheet material covering the resilient frame member, a first side and a second side. The first side of each of the structures is hingedly connected with the second side of another of the structures so that all the structures are connected together to form an enclosed space. Each structure may be placed on top of another structure when their frame members are in the unfolded orientation to form a stack of structures, and the frame members of the stack of structures may be twisted and folded to form a plurality of concentric loops in the folded orientation of the frame members to substantially reduce the sizes of the structures. At least one opening may be provided on one of the sheet materials to communicate air to the enclosed space.

The collapsible flying structures according to the present invention are convenient for use since they are easily and quickly folded and collapsed into a smaller size for transportation and storage. The ability to fold and collapse the collapsible flying structures of the present invention allow these flying structures to be provided in larger sizes and different configurations, colors and designs, thereby rendering them easier to fly and increasing the variety and location of use afforded to the user.

DETAILED DESCRIPTION OF THE PREFERRED EMBODIMENTS

Figures 1, 2:
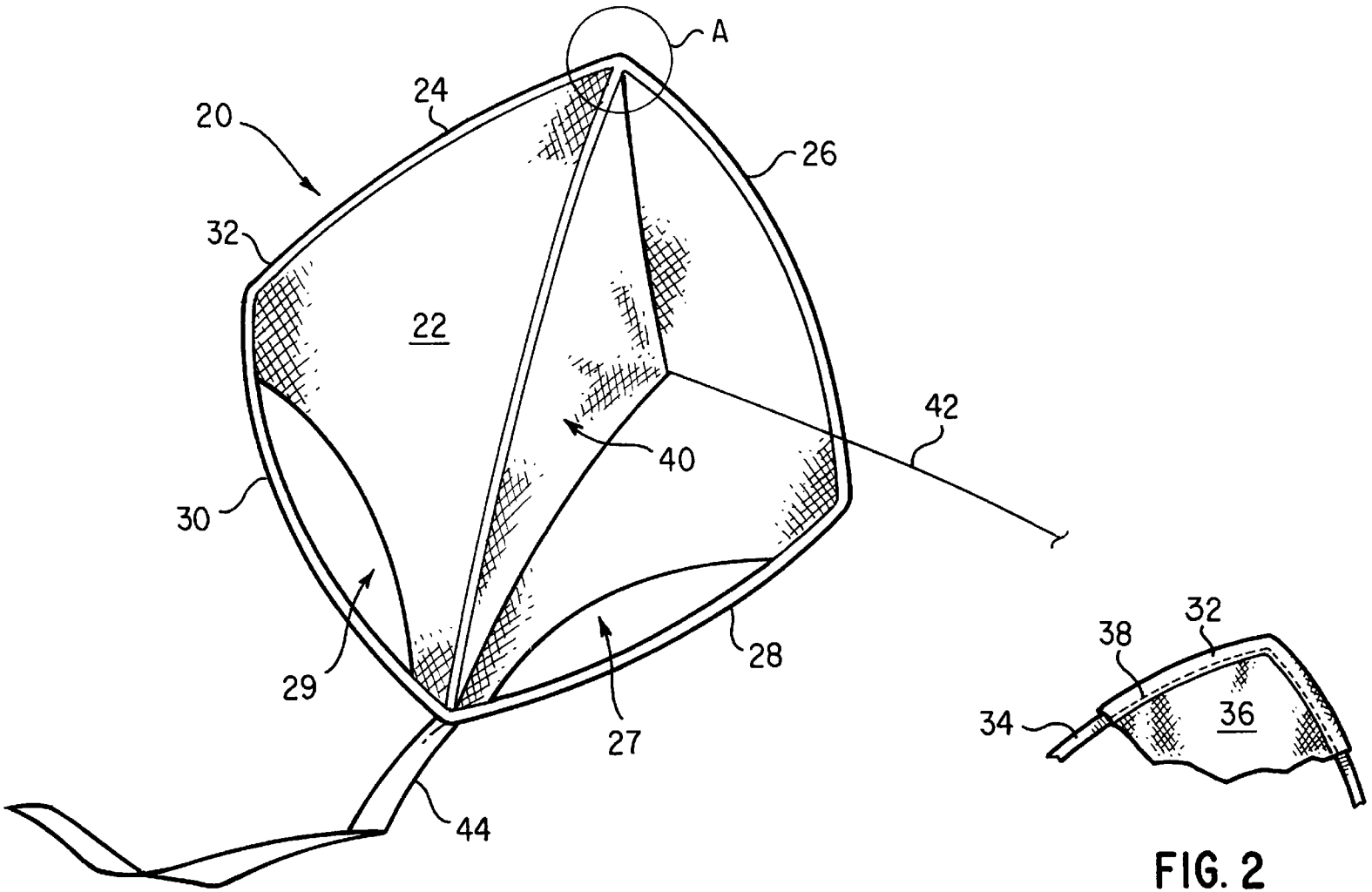
FIG. 1 is a perspective view of a collapsible flying structure according to a first preferred embodiment of the present invention shown in use in its expanded configuration.
FIG. 2 is a partial cut-away view of the section A of the structure of FIG. 1 illustrating a frame member retained within a sleeve.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible flying structures that can assume an expanded configuration and a collapsed configuration, and which can be twisted and folded from the expanded configuration to reduce the overall size of the flying structure in the collapsed configuration. The collapsible flying structures are each supported by at least one support frame having a panel substantially spanning the support frame in a taut fashion.

A first embodiment of the present invention is illustrated in connection with FIGS. 1 and 2. A collapsible flying structure 20 is made up of a panel 22 having four sides 24, 26, 28 and 30 that define a generally square or diamond configuration. The panel 22 has a continuous frame retaining sleeve 32 provided along and traversing the edges of the four sides 24, 26, 28 and 30. A sheet material 36 (described in greater detail below) spans a substantial portion of the space enclosed by the sides 24, 26, 28, 30, and defines two openings 27 and 29 between the sheet material 36 and the sides 28 and 30, respectively. These openings 27, 29 are provided to allow air to flow therethrough in order to help get the flying structure 20 to get airborne.

A continuous frame member 34 is retained or held within the frame retaining sleeve 32 to support the panel 22. The continuous frame member 34 may be provided as one continuous enclosed loop, or may be a strip of material connected at both ends to form an enclosed loop. The continuous frame member 34 is preferably formed of flexible coilable steel, although other materials such as plastics may also be used. The frame member 34 should be made of a material which is relatively strong and yet is flexible and resilient to a sufficient degree to allow it to be coiled. Thus, the frame member 34 is capable of assuming two positions, an open or expanded position such as shown in FIG. 1, or a folded position in which the frame member 34 is collapsed into a size which is much smaller than its open position (see FIG. 3D).

The frame member 34 may be merely retained within the frame retaining sleeve 32 without being connected thereto. Alternatively, the frame retaining sleeve 32 may be mechanically fastened, stitched, fused, or glued to the frame member 34 to retain the frame member 34 in position.

The panel 22 is defined by a sheet material 36 which extends across the panel 22, and is held taut by the frame members 34 when in the frame member's 34 open or expanded position. The term "sheet material" is to be given its broadest meaning and should be made from strong, foldable, flexible and lightweight materials and may include vinyl, fabrics, spunbond materials (such as tyvek), woven fabrics, sheet fabrics, meshed materials, or even films.

The sheet material 36 and the frame retaining sleeve 32 may be provided separately and then stitched together along stitch line 38, or they may be attached together by other conventional mechanisms and methods. Alternatively, the sleeve 32 may be made from an extension of the sheet material 36 by folding the peripheral edge of the sheet material 36 over the frame member 34 and then applying a stitch line (such as 38) to form the sleeve 32.

A generally triangular control panel 40 is provided along a central portion of the sheet material 36 of the panel 22. The control panel 40 can be provided with the same material as the sheet material 36. The control panel 40 provides channels or spaced regions on either side thereof through which the wind may flow, thereby helping to promote the flight of the flying structure 20. The control panel 40 also helps to control the flying structure 20 in an upward orientation when it gets airborne off the ground, and to direct the flying structure 20 in different directions. In the embodiment illustrated in FIG. 1, the control panel 40 extends entirely across the central portion of the panel 22 between two opposing points of the frame retaining sleeve 32 to provide support along the entire central portion. However, as illustrated in the other embodiments below, the control panel 40 does not necessarily need to extend entirely across the panel 22 between two opposing points of the sleeve 32. One end of a control string or rope 42 is attached to the control panel 40 to allow the user to control the flying structure 20. A grip or handle bar (not shown) may be attached to the other end of the control string 42 for the user to grip or hold in controlling the flying structure 20.

Ribbons 44 may be provided along the peripheral edge (e.g., along the frame retaining sleeve 32) of the flying structure 20 to enhance the aesthetic appearance of the structure 20. In addition, one or both sides of the panel 22, and of the panels in any of the embodiments illustrated below, may be provided with a wide variety of decals, designs, colors, accessories (e.g., whistles) and patterns for selection by the user.

Figure 3A:
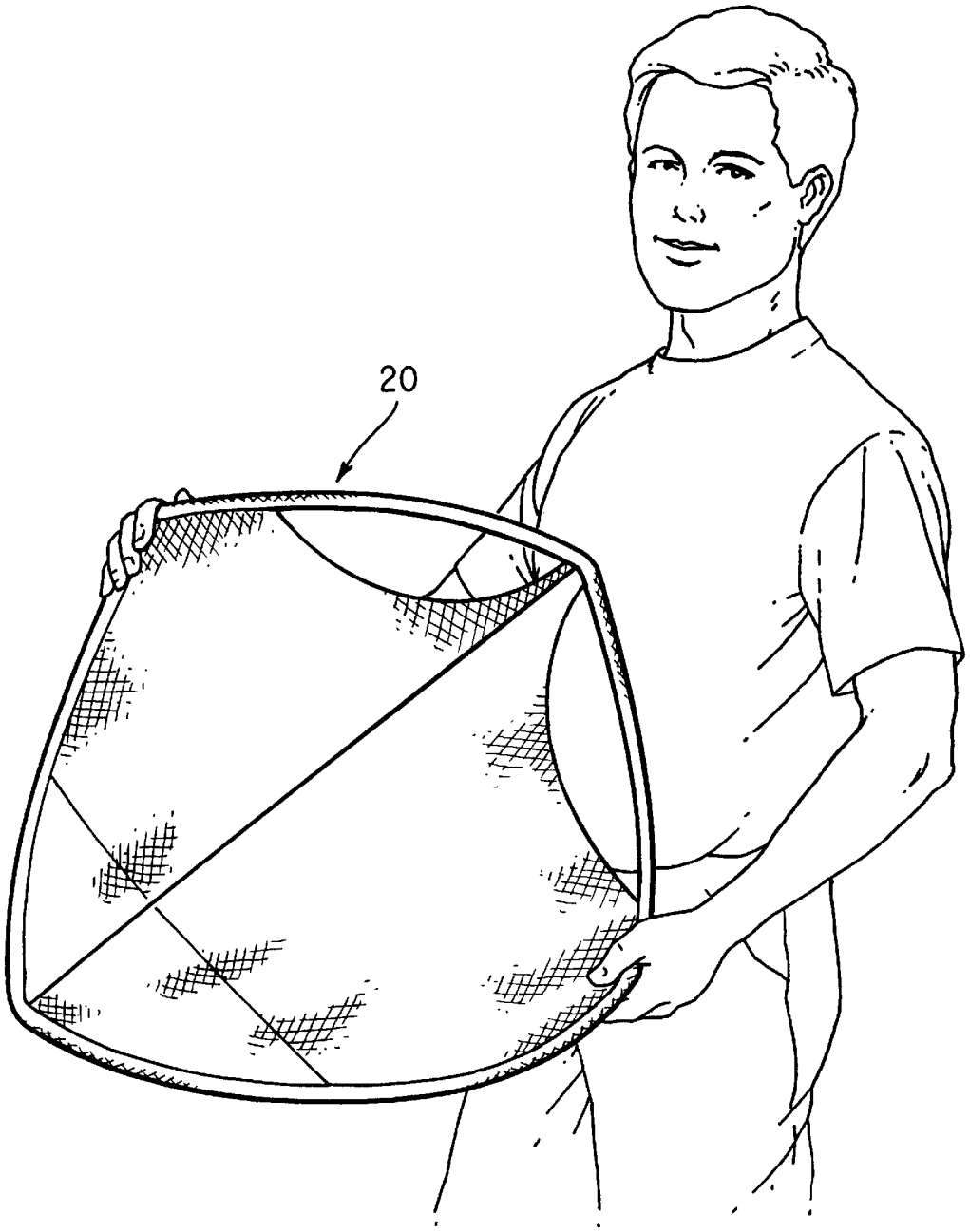
FIGS. 3(A) through 3(D) illustrate how the flying structure of FIG. 1 may be twisted and folded for compact storage.
Figure 3B:
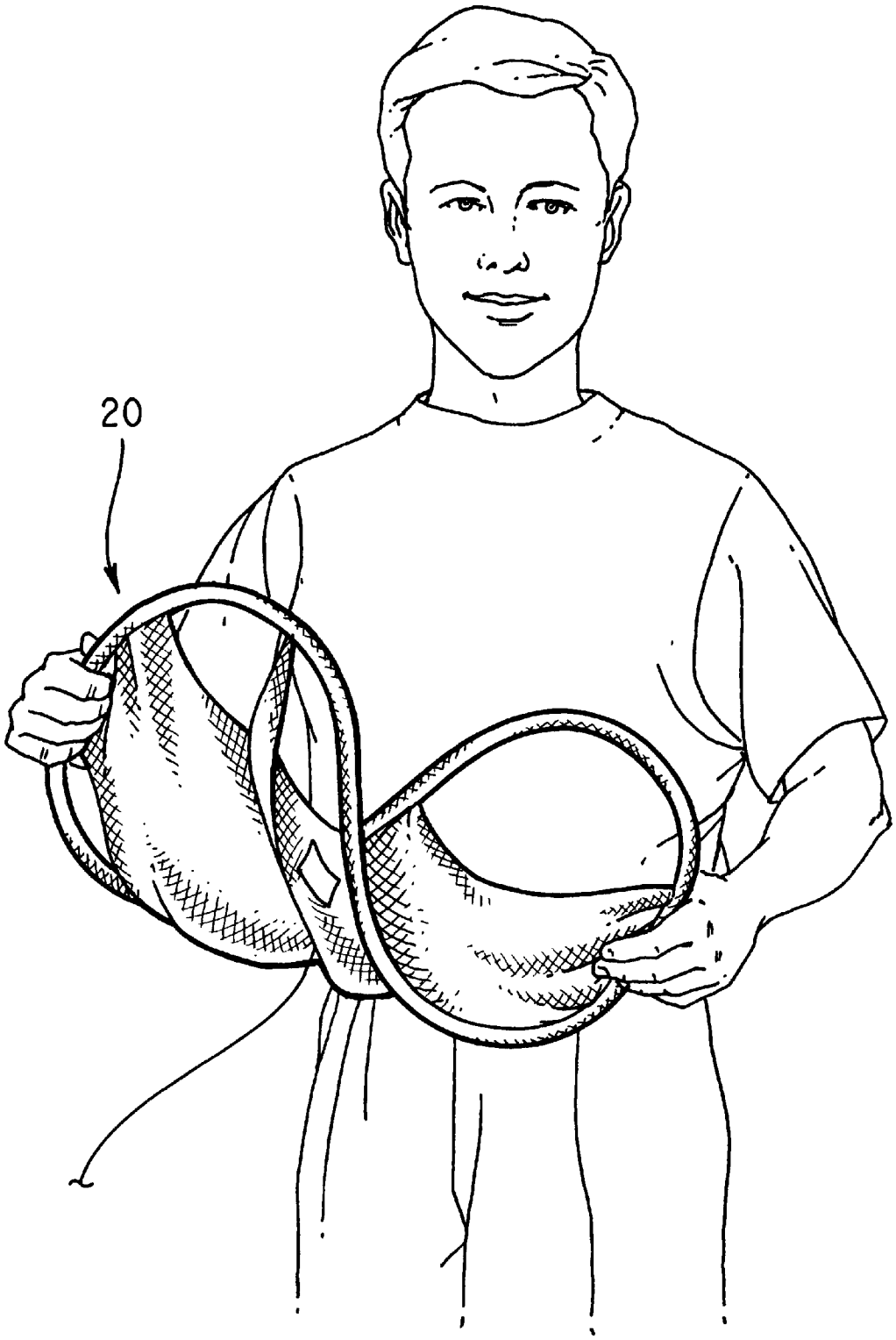
Figure 3C:
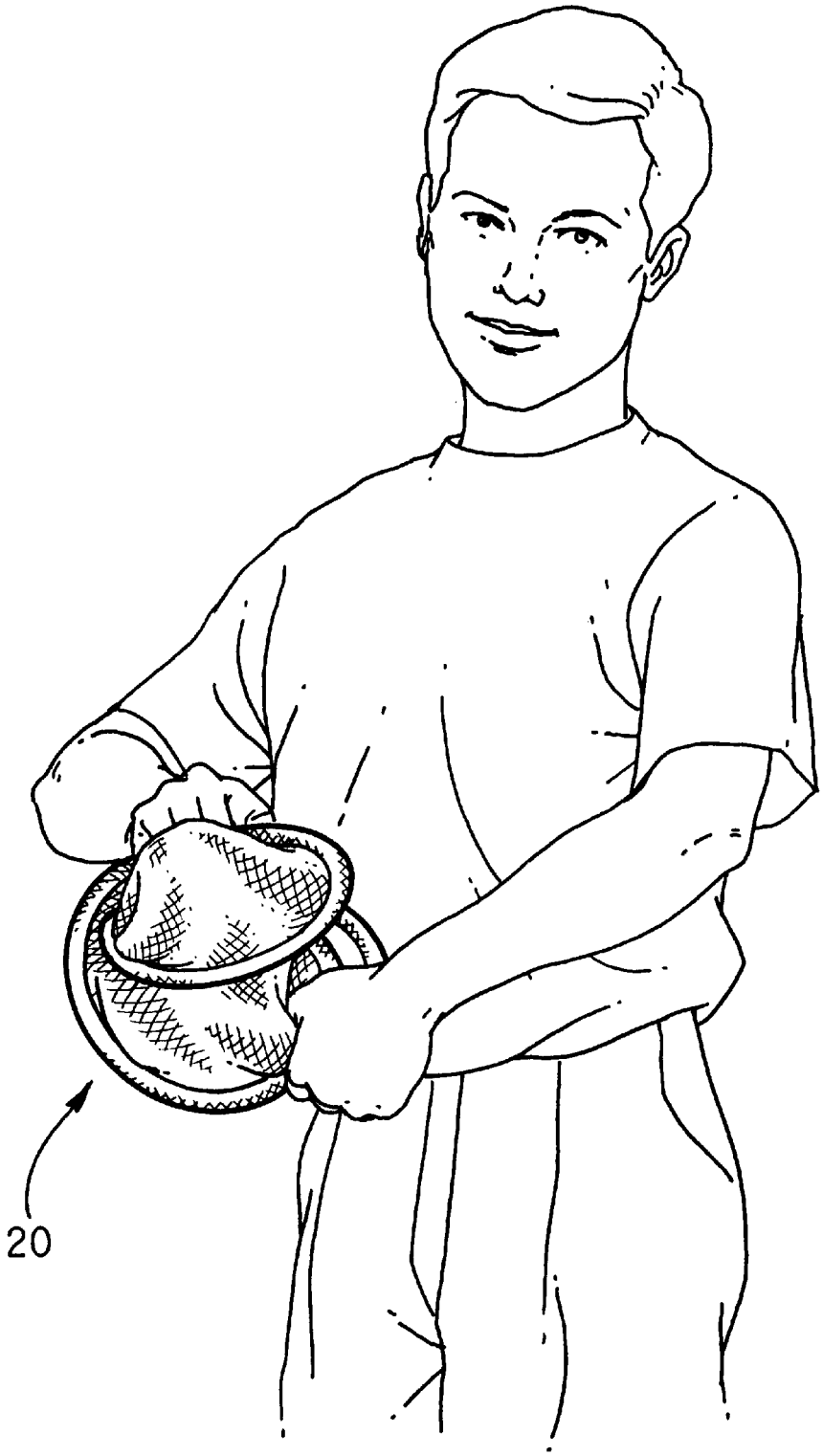
Figure 3D:
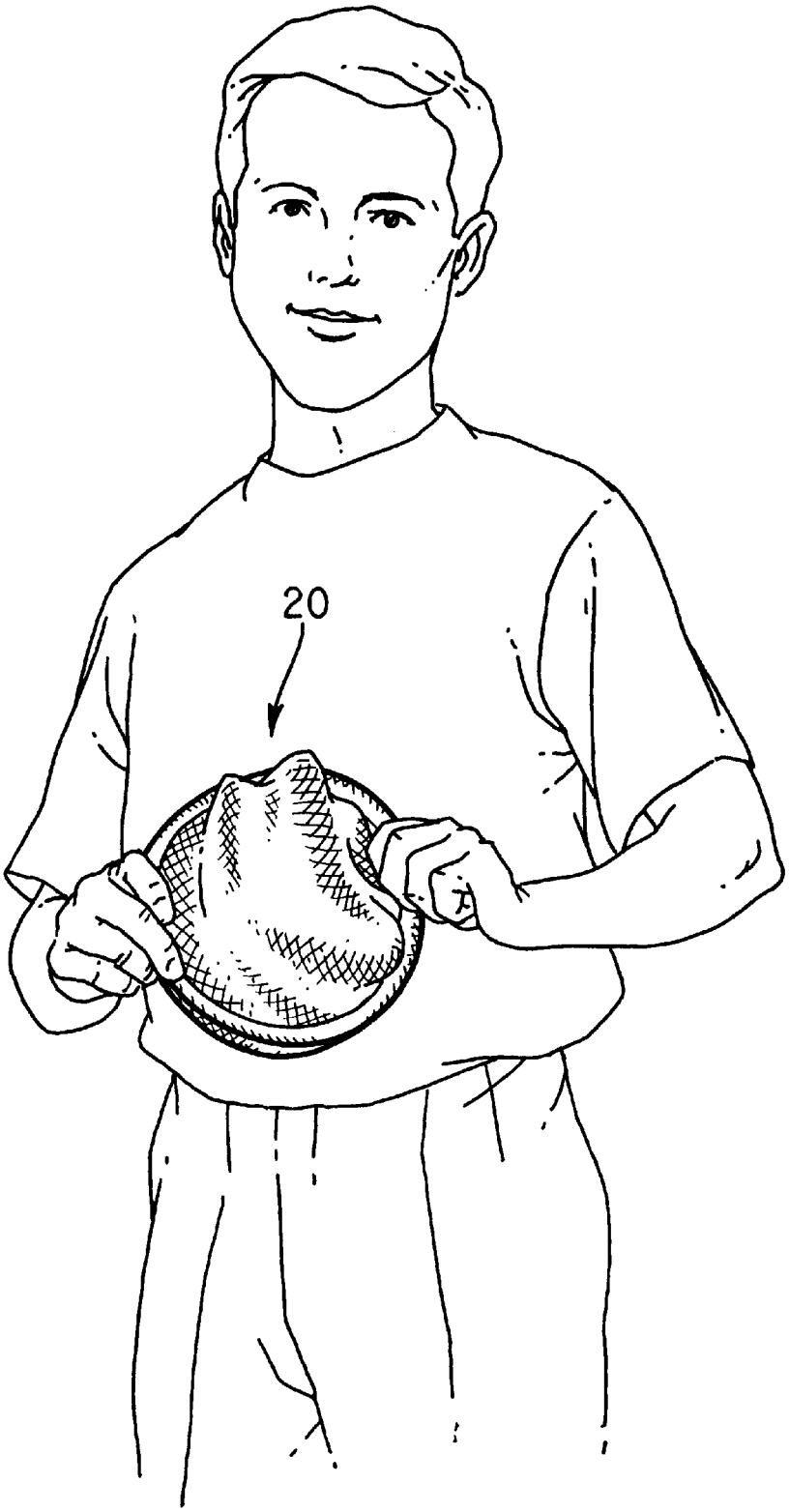

FIGS. 3A through 3D describe the steps for folding and collapsing the flying structure 20 into a compact configuration for transportation and storage. In the first step shown in FIG. 3A, each of the opposite borders of the flying structure 20 is held by a separate hand. The opposite borders are then turned in opposite directions to form a "Figure-8" shape (see FIG. 3B). Further twisting and folding (see FIG. 3C) causes the frame member 34 and panel 22 to form a plurality of concentric frame members and panels. FIG. 3D shows the frame member 34 and panel 22 collapsed on each other to provide for a small essentially compact configuration having a plurality of concentric frame members and layers of the panel so that the collapsed flying structure 20 has a size which is a fraction of the size of the initial flying structure 20. During the folding and collapsing steps of FIGS. 3A–3D, the control panel 40 is folded against the panel 22, and is folded and collapsed together with the panel 22. To open the flying structure 20 to its expanded configuration, the collapsed frame member 34 and its panel 22 are unfolded, and the springy nature and natural bias of the frame member 34 will cause the flying structure 20 to spring open to the expanded configuration.

The flying structure 20 in FIG. 1 is illustrated as having a basic configuration. The flying structures of the present invention can be provided in a variety of external shapes and sizes. The embodiments below illustrate certain non-limiting examples of these flying structures having different shapes and sizes.

Figure 4:
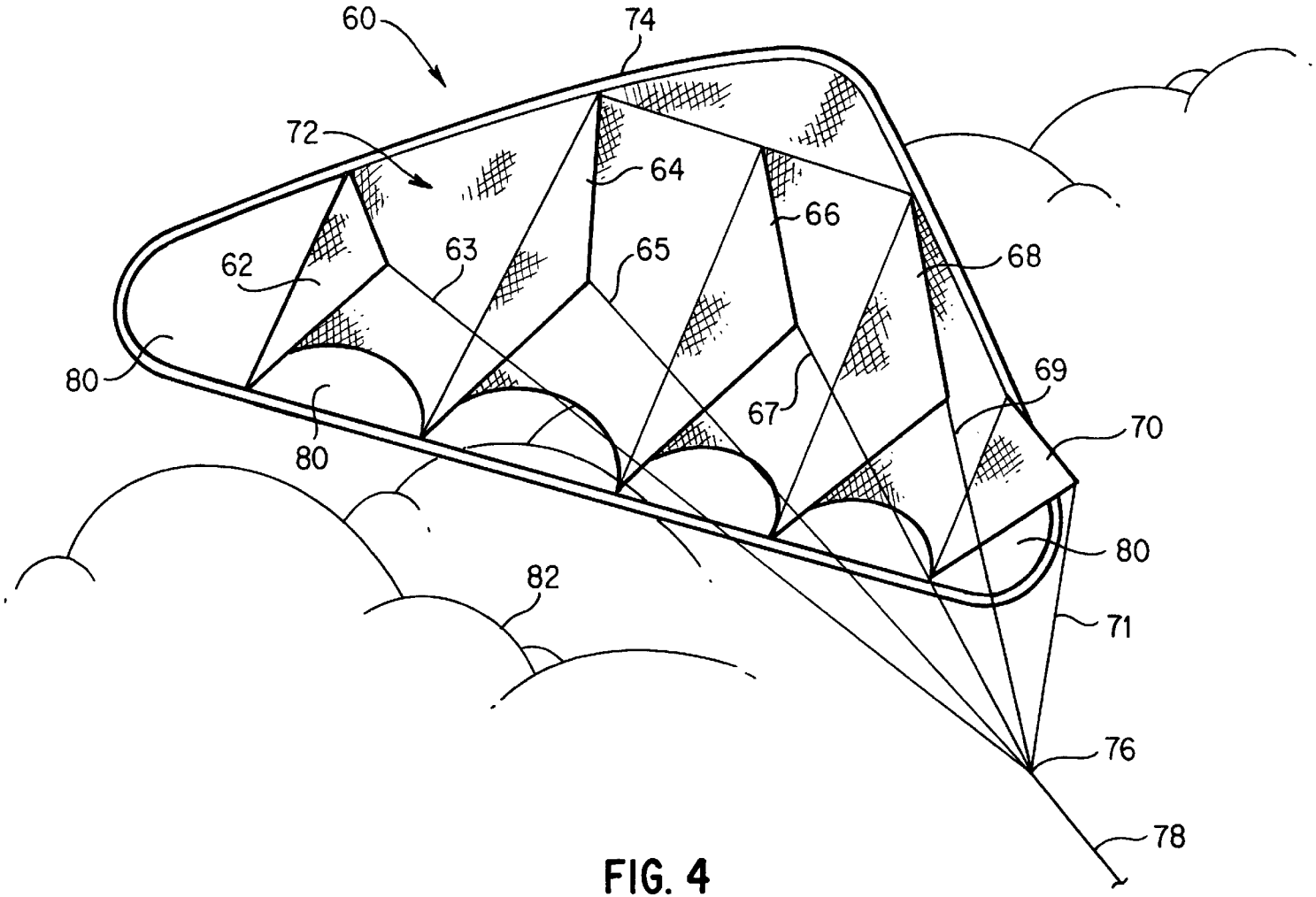
FIG. 4 is a perspective view of a collapsible flying structure according to a second preferred embodiment of the present invention shown in use in its expanded configuration.

A second preferred embodiment of the present invention is shown in FIG. 4. The flying structure 60 is similar to flying structure 20 except that flying structure 60 has a generally triangular configuration and is provided with five control panels 62, 64, 66, 68 and 70. Except for control panel 66, the other four control panels 62, 64, 68 and 70 extend entirely across the panel 72 between two opposing points of the frame retaining sleeve 74. Five control strings 63, 65, 67, 69 and 71 are attached at one end to the control panels 62, 64, 66, 68 and 70, respectively. The other end of the control strings 63, 65, 67, 69 and 71 may be tied together or otherwise connected at 76 to one end of a combined control string 78. A plurality of openings 80 may be provided along the peripheral edge of the panel 72. One or more decorative ribbons 82 may also be attached to the panel 72 or the frame retaining sleeve 74. The flying structure 60 may be folded and collapsed according to the same method described above in FIGS. 3A–3D, and may be opened to the expanded configuration using the method described above in connection with flying structure 20.

Figure 5A:
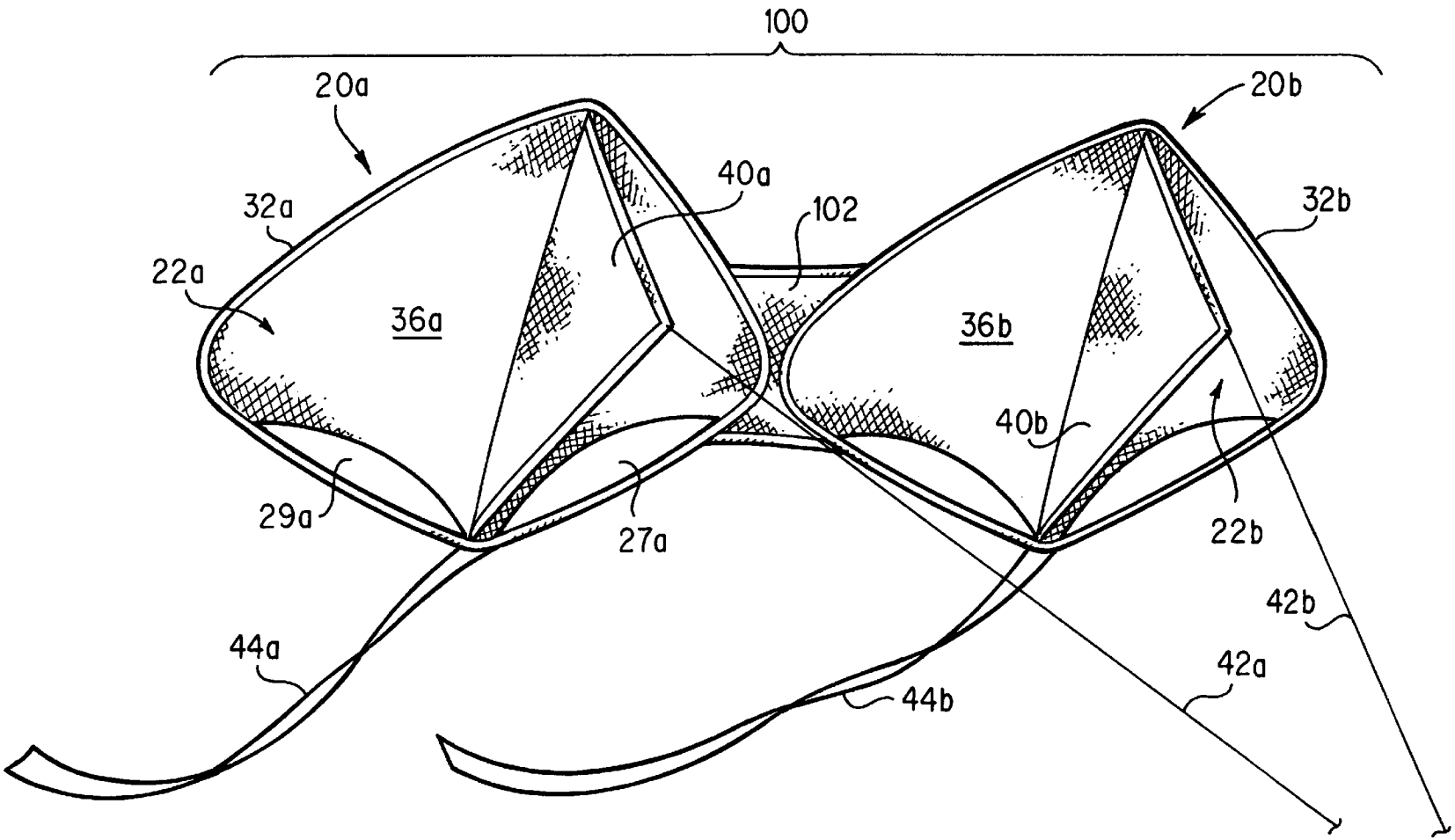
FIG. 5A is a perspective view of a collapsible flying structure according to a third preferred embodiment of the present invention shown in use in its expanded configuration.

Referring now to FIG. 5A, a third embodiment of the present invention provides a flying structure 100 made of two structures 20*a* and 20*b* that are each identical to the flying structure 20. A connector piece 102 operates to connect the two structures 20*a* and 20*b*. The connection can be made at any part of either structure 20*a* and 20*b*. For example, the connection in FIG. 5A is illustrated as being between two adjacent corners of the structures 20*a* and 20*b* in a manner in which the two structures 20*a* and 20*b* are horizontally aligned when placed on a flat surface in a side-by-side manner. The connector piece 102 may be connected to the structures 20*a* and 20*b* by any secure connection mechanism which is strong enough to prevent separation of the connector piece 102 from the structures 20*a* and 20*b* during use. For example, the connector piece 102 may be stitched to the sheet material 36*a* and 36*b* of the structures 20*a* and 20*b*, or to the frame retaining sleeves 32*a* and 32*b* of the structures 20*a* and 20*b*, to provide a non-detachable connection. Alternatively, a detachable or removable connection can be provided by using connection mechanisms such as opposing Velcro™ pads, hooks, fasteners, buttons, snap-fit engagements, loops, snap buckles, zippers or ties. The connector piece 102 may be made of the same material as the sheet material 36.

Non-limiting alternatives to the connector piece 102 can be provided. For example, discrete connecting elements that can be used to connect the two structures 20*a*, 20*b* include one or more thin connecting straps, one or more rope or thread segments, zippers, tie members, opposing hooks, opposing fasteners, buttons, snap-fit engagements, loops, or snap buckles. All these connecting elements operate in a similar manner as the connector piece 102, by providing opposite ends that are attached to the two different structures 20*a*, 20*b*. In addition, many of these connecting elements are also capable of operating as a hinge to allow one structure 20*a* or 20*b* to be folded upon the other structure 20*b* or 20*a*, respectively.

As a further example, the two structures 20*a*, 20*b* can be directly connected to each other by stitching or otherwise connecting the frame retaining sleeves 32*a* and 32*b* of the two structures 20*a*, 20*b*. When connected in this manner, the stitching will operate as a hinge to allow one structure 20*a* or 20*b* to be folded upon the other structure 20*b* or 20*a*, respectively.

Each control string 42*a* and 42*b* has one end that is attached to the control panels 40*a* and 40*b*, respectively, of the structures 20*a* and 20*b*, respectively. The other end of the control strings 42*a*, 42*b* may be controlled separately by the user, or may be connected together to one combined control string, such as the combined control string 78 illustrated in FIG. 4.

To fold and collapse the flying structure 100, one structure 20*a* or 20*b* may be folded upon the other structure 20*b* or 20*a*, respectively, about the connector piece 102 which acts as a hinge so that the structures 20*a* and 20*b* are placed one on top of the other. The combined structures 20*a* and 20*b* can then be folded and collapsed according to the method described above in FIGS. 3A–3D. Alternatively, if the connections between connector piece 102 and the structures 20*a* and 20*b* are detachable, it is also possible to remove the connector piece 102 from both structures 20*a*, 20*b*, and then place the separated structures 20*a*, 20*b* one on top of the other. The connector piece 102 can be sandwiched between the two structures 20*a*, 20*b*, or placed on top of the stack of structures 20*a*, 20*b*, and the combined structures 20*a*, 20*b* and connector piece 102 can then be folded and collapsed according to the method described above in FIGS. 3A–3D. Therefore, providing a detachable connector piece 102 allows the user to fold and collapse the flying structure 100 using one of two methods. If a non-hingeable connecting element is used, the separate structures 20*a*, 20*b* must be detached and separated before the folding and collapsing steps.

To open and assemble the flying structure 100, the collapsed stack of structures 20*a*, 20*b* is opened in the manner described above so that both structures 20*a*, 20*b* are opened to their expanded configurations. One structure 20*a* or 20*b* is then folded away from the other structure 20*b* or 20*a* about the hinge, and the flying structure 100 is ready for use. If the connector piece 102 has been detached, then the connector piece 102 will need to be attached to the structures 20*a*, 20*b*, if the user so desires. Otherwise, the user can also fly one of the structures 20*a* or 20*b* alone, without using the other structure 20*b* or 20*a*, respectively.

Thus, the flying structure 100 provides variety in use, since it can be used in many ways. The user can fly the combined flying structure 100, or separate the two structures 20*a* and 20*b* and fly each or both of them separately. The flying structure 100 can also be folded, collapsed and stored with the connector piece 102 attached to the structures 20*a*, 20*b*, or with the connector piece 102 removed, thereby providing flexibility in use and storage.

Figure 5B:
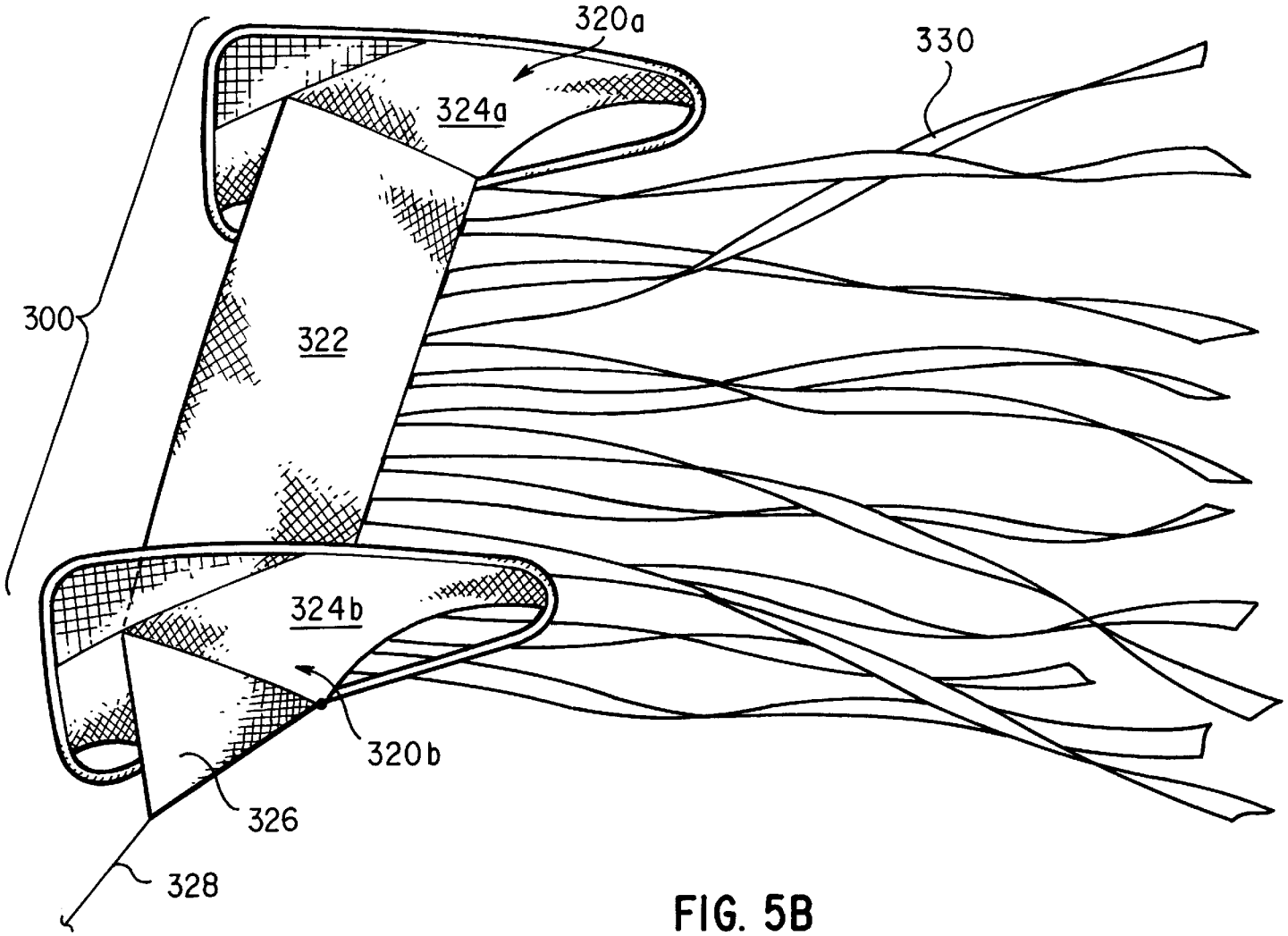
FIGS. 5B–5E are perspective views illustrating modifications to the collapsible flying structure of FIG. 5A.
Figure 5C:
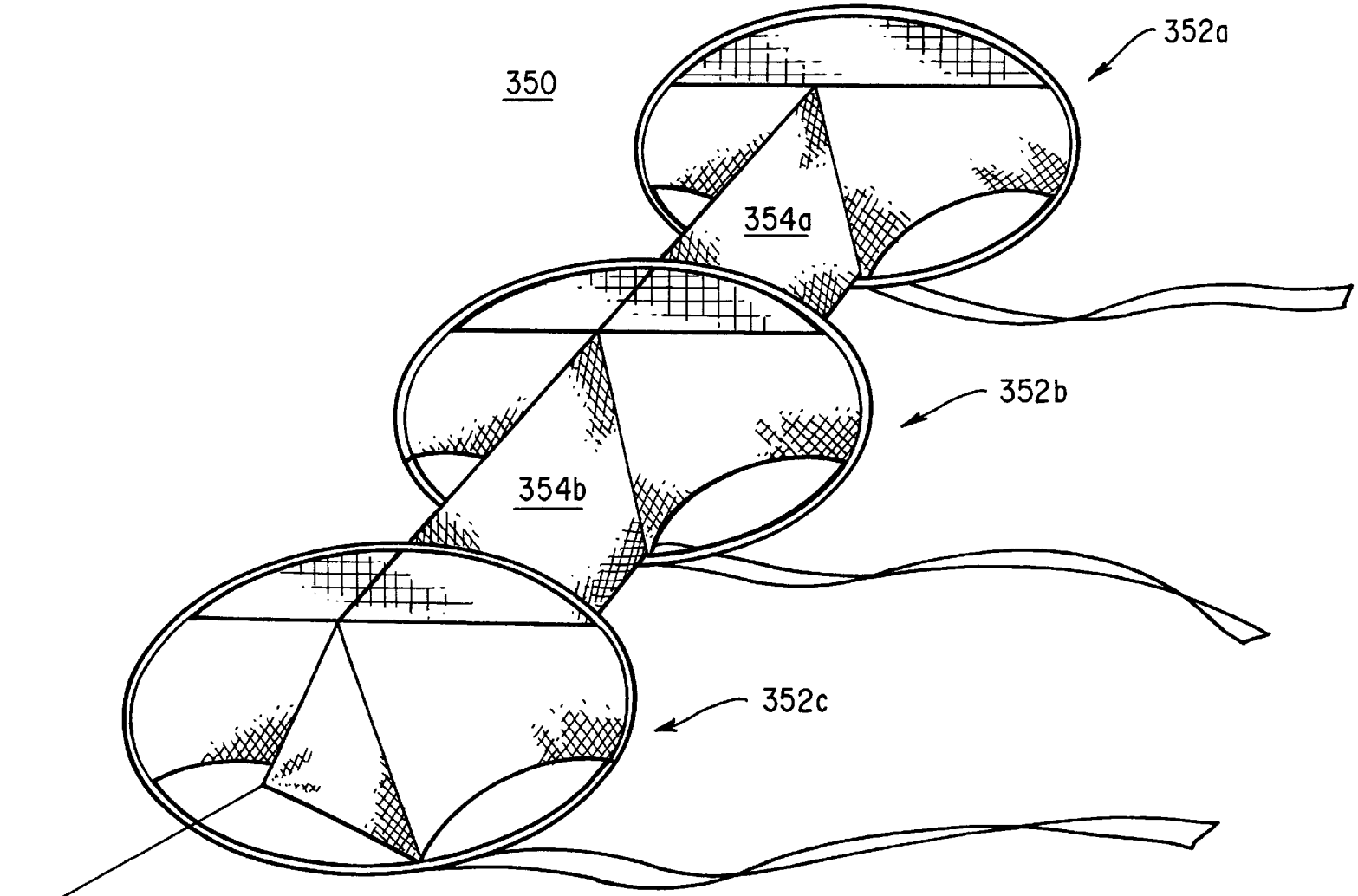
Figure 5D:
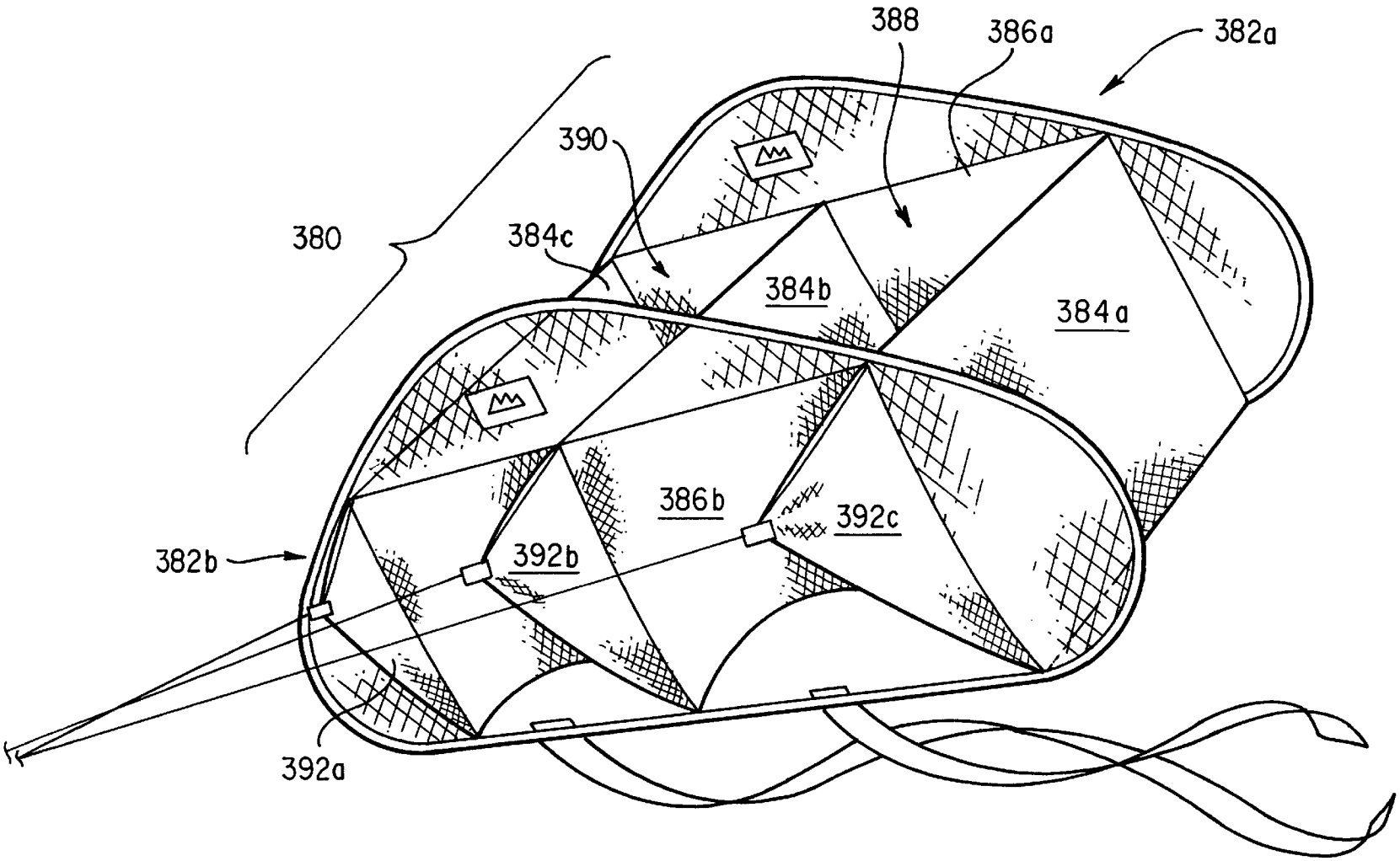

FIGS. 5B–5D illustrate modifications that can be made to the flying structure 100 of FIG. 5A. In FIG. 5B, the flying structure 300 has two structures 320*a* and 320*b* that are similar to the structure 20 illustrated in FIG. 1, except that structures 320*a* and 320*b* have a different shape (e.g., generally triangular). The connector piece 322 has opposing ends, each of which is connected to the sheet material 324*a* and 324*b* of a separate structure 320*a* and 320*b*, respectively. Each structure 320*a*, 320*b* can still have a control panel 326 and a control string 328. A plurality of ribbons 330 can be provided along the rear of the connector piece 322. The connector piece 322 can be connected to the sheet materials 324*a*, 324*b* at an orientation where the connector piece 322 is angled when it is in flight (as shown in FIG. 5B), to promote the aerodynamics and lift properties of the flying structure 300.

It is also possible to connect more than two of the structures 20 of FIG. 1 together to form a multi-structured flying kite or structure. FIG. 5C illustrates a flying structure 350 that incorporates the principles of FIGS. 1, 5A and 5B. In particular, the flying structure 350 has three separate structures 352*a*, 352*b*, 352*c* that are similar to the structure 20 illustrated in FIG. 1, except that structures 352*a*, 352*b* and 352*c* have a different shape (e.g., oval). Two connector pieces 354*a* and 354*b* are provided, with one connector piece 354*a* connecting structures 352*a* and 352*b*, and the other connector piece 354*b* connecting structures 352*b* and 352*c*. Thus, the flying structure 350 is very similar to flying structure 300 of FIG. 5B, except that an additional connector piece 354*b* is provided to allow a third structure 352*c* to be added to the combined flying structure 350.

FIG. 5D illustrates a flying structure 380 that is similar to flying structure 300 of FIG. 5B in that two structures 382*a* and 382*b* make up the combined flying structure 380. However, instead of one connector piece 322, a plurality of connector pieces (in this case, three) 384*a*, 384*b* and 384*c* are connected between the sheet materials 386*a* and 386*b* of the structures 382*a* and 382*b*, respectively. The three connector pieces 384*a*, 384*b* and 384*c* extend between the structures 382*a* and 382*b* and define further air channels 388 and 390 therebetween that further improve the aerodynamic and flight characteristics of the flying structure 380. The structure 382*b* has three control panels 392*a*, 392*b*, 392*c*.

Figure 5E:
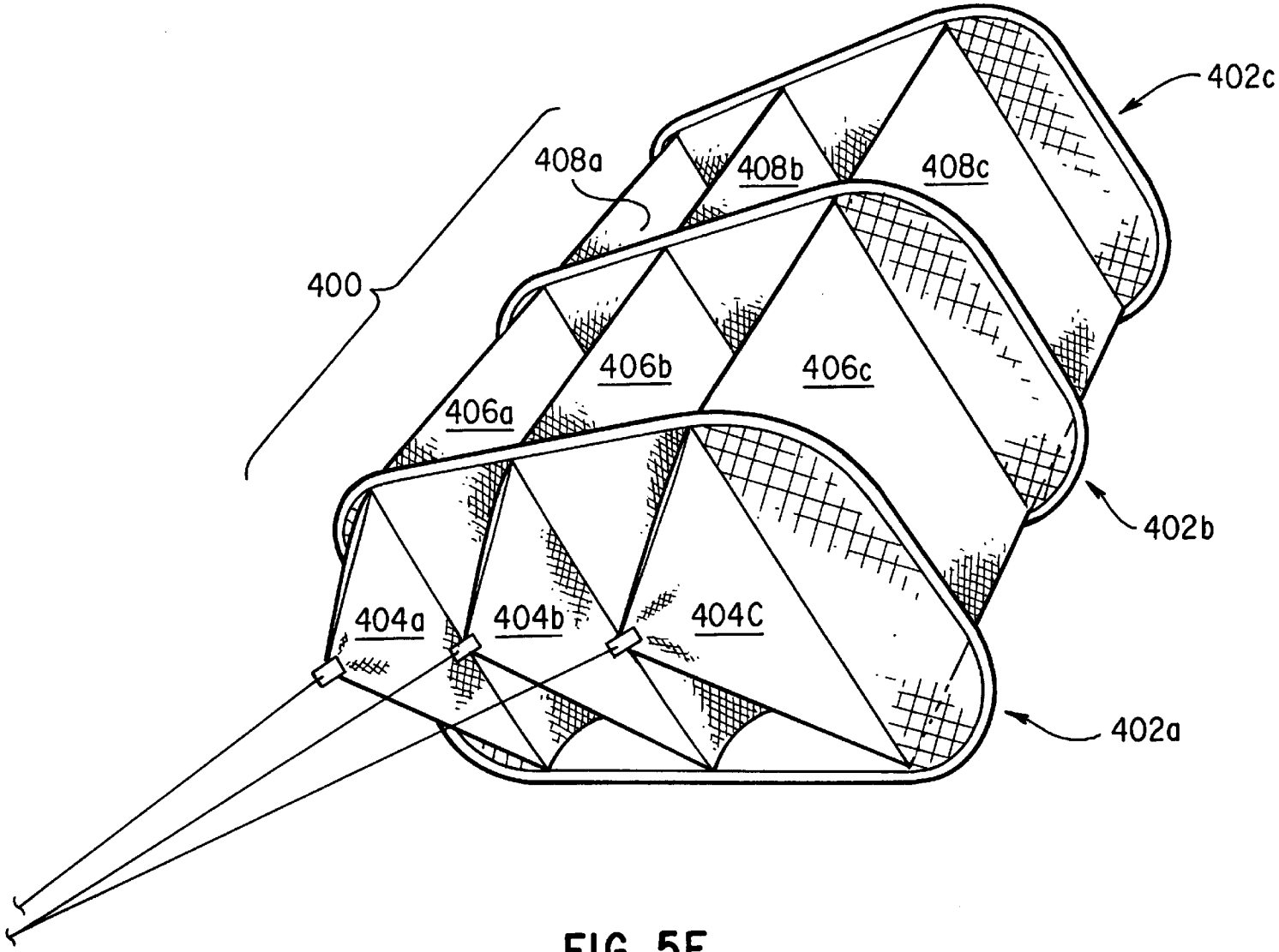

The flying structure 400 in FIG. 5E incorporates the principles illustrated in FIGS. 5C and 5D. The flying structure 400 has three structures 402*a*, 402*b*, 402*c*, with structure 402*a* having three control panels 404*a*, 404*b*, 404*c*. Three connector pieces 406*a*, 406*b* and 406*c* are connected and extend between the structures 402*a* and 402*b*, and three connector pieces 408*a*, 408*b* and 408*c* are connected and extend between the structures 402*b* and 402*c* in the same manner as for flying structure 380 described above.

The flying structures 300, 350, 380 and 400 can be folded and collapsed by placing the respective structures 320, 352, 382 and 402 on top of each other to form a stack of structures, with the connector pieces 322, 354, 384 and 406, 408 tucked between the respective structures 320, 352, 382 and 402, and then folding and collapsing the combined stack according to the method illustrated in FIGS. 3A–3D above.

Figure 6:
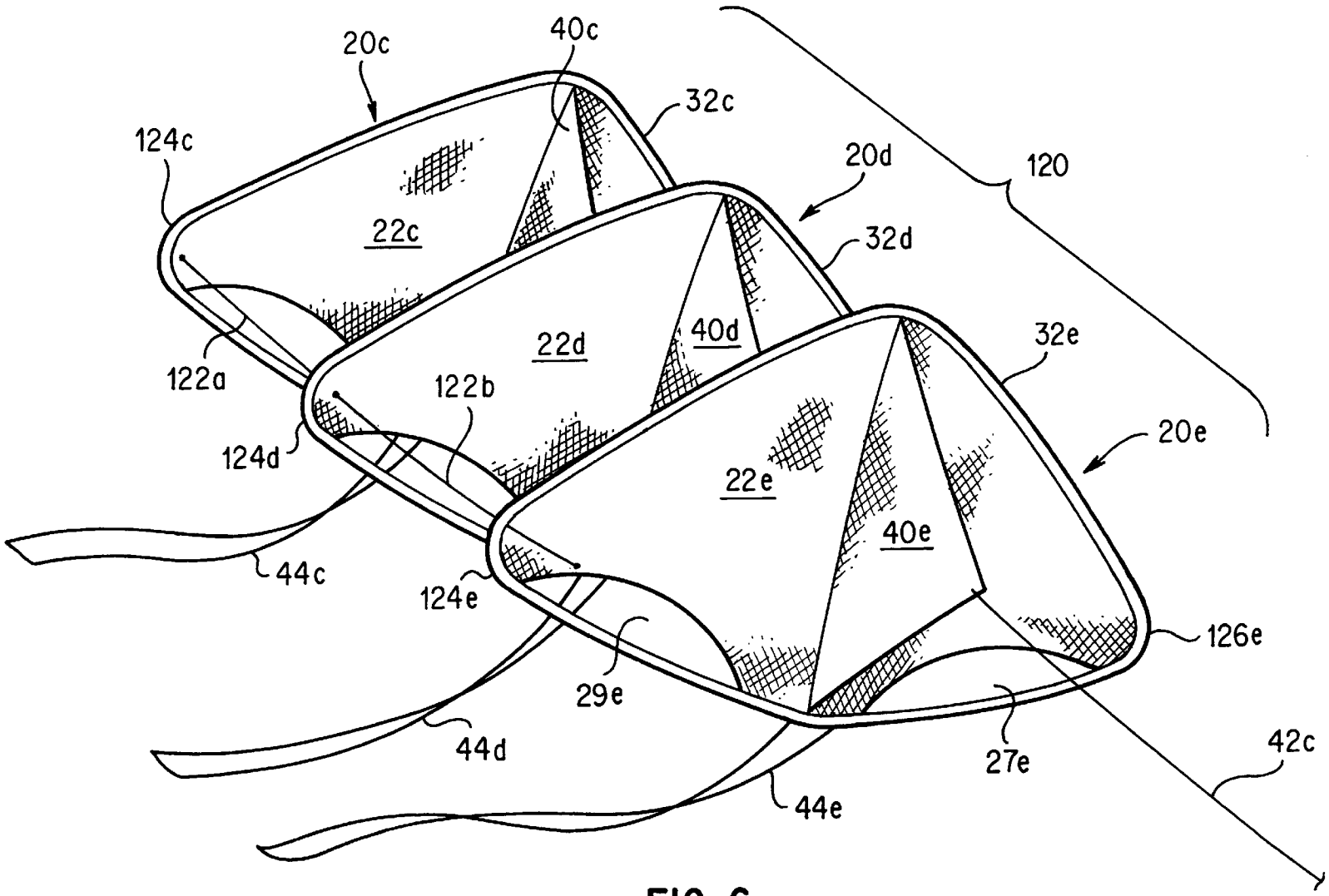
FIG. 6 is a perspective view of a collapsible flying structure according to a fourth preferred embodiment of the present invention shown in use in its expanded configuration.

FIG. 6 illustrates another example of how the principles of the present invention can be used to connect more than two of the structures 20 of FIG. 1 together to form a multi-structured flying kite or structure. In FIG. 6, the flying structure 120 includes three structures 20*c*, 20*d* and 20*e* that are each identical to the flying structure 20. The three separate structures 20*c*, 20*d*, 20*e* are connected together by threads or strings. Specifically, a first thread 122*a* connects the panel 22*c* or frame retaining sleeve 32*c* at a left-most corner 124*c* of the structure 20*c* with the panel 22*d* or frame retaining sleeve 32*d* at a left-most corner 124*d* of the structure 20*d*, and a second thread 122*b* connects the panel 22*e* or frame retaining sleeve 32*e* at a left-most corner 124*e* of the structure 20*e* with the panel 22*d* or frame retaining sleeve 32*d* at the left-most corner 124*d* of the structure 20*d*. Similar threads (not shown) are used to connect the right-most corners (right-most corner 126*e* is illustrated) of the structures 20*c*, 20*d* and 20*e*. These threads 122*a*, 122*b* function to space the three structures 20*c*, 20*d* and 20*e* apart from each other when the flying structure 120 is being used, so that air can flow through the spaces between the three structures 20*c*, 20*d*, 20*e*. The threads 122*a* and 122*b* can also be detachable, so that the three structures 20*c*, 20*d*, 20*e* can be separated into three separate flying structures, or one flying structure having two of the three structures 20*c*, 20*d*, 20*e*. This flexibility increases the variety of use, and enhances the entertainment value of the flying structure 120. In addition, the control panels 40*c* and 40*d* can be removably attached (such as by the removable connection mechanisms described above) or permanently attached (such as by stitching) to the panels 22*d* and 22*e*, respectively.

To fold and collapse the flying structure 120 for storage and transportation, the three structures 20*c*, 20*d*, 20*e* are placed one on top of the other to create a stack of three structures 20*c*, 20*d*, 20*e*. Each control panel 40*c* and 40*d* can be folded or pressed against an adjacent panel 22*c*, 22*d* and 22*e*, or sandwiched between two of the panels 22*c*, 22*d*, 22*e*. If the user so desires, the threads 122*a*, 122*b* can be removed, the control panels 40*c* and 40*d* detached, and the structures 20*c*, 20*d*, 20*e* separated. The combined structures 20*c*, 20*d* and 20*e* can then be folded and collapsed according to the method described in FIGS. 3A–3D. To open and assemble the flying structure 120, the collapsed stack of structures 20*c*, 20*d*, 20*e* is opened in the manner described above so that the structures 20*c*, 20*d*, 20*e* are opened to their expanded configurations, and the flying structure 120 is ready for use. If the threads 122*a*, 122*b* and the control panels 40*c*, 40*d* have been detached, they will need to be re-attached to the structures 20*c*, 20*d*, 20*e*, if the user so desires.

Figure 7:
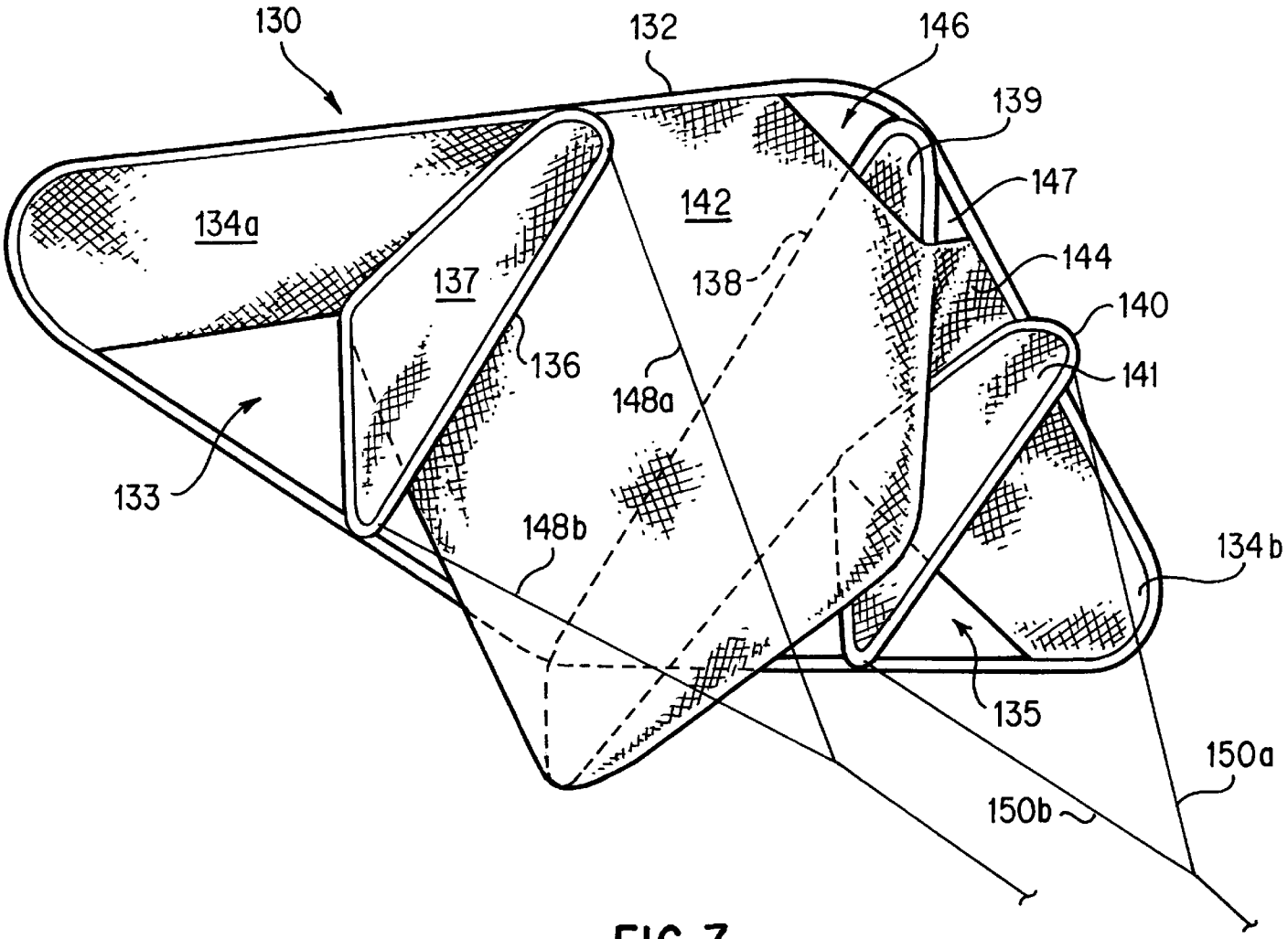
FIG. 7 is a perspective view of a collapsible flying structure according to a fifth preferred embodiment of the present invention shown in use in its expanded configuration.

The flying structures according to the present invention can also be provided with two or more frame members for each specific structure. An example is illustrated in FIG. 7, in which a flying structure 130 has a peripheral frame member 132 supporting two pieces of sheet materials 134*a*, 134*b*, and further includes three additional frame members 136, 138, 140 that support three control panels 137, 139 and 141, respectively. These frame members 136, 138, 140 are provided in spaced-apart manner, with the frame retaining sleeves of these frame members 136, 138, 140 attached to the frame retaining sleeve of the frame member 132 by stitching or any other conventional connecting mechanism. Control panels 137 and 141 can be removably attached using one of the removable connection mechanisms described above. The pieces of sheet material 134*a*, 134*b*, are attached to the frame retaining sleeves of the frame member 132 and the frame members 136 and 140, respectively, defining openings 133 and 135 between the frame member 132 and the sheet materials 134*a*, and 134*b*, respectively.

Two angled pieces of sheet material 142 and 144 may be attached to the frame retaining sleeves of the frame member 132 and one of the control panels (e.g., 139) so that the angled sheet materials 142, 144 extend at an angle with respect to the plane defined by the frame member 132 when in its open or expanded configuration. The control panels 137, 139, 141 and the sheet materials 142, 144 are intended to perform the same functions as the control panel 40 described above. In particular, several wind channels are created by the configuration of the flying structure 130. For example, one wind channel 146 is defined between the panel 139 and the sheet material 142, and another wind channel 147 is defined between the panel 139 and the sheet material 144. Openings 133 and 135 also define wind channels to allow air to pass through. These wind channels help to enhance the flight and performance of the flying structure 130 since air fills or passes through these channels 146, 147, 133, 135 to help get the flying structure 130 airborne, and to maintain the shape and structural integrity of the flying structure 130 when it is airborne.

Control strings can be attached to selected control panels. For example, control strings 148*a* and 148*b* may be attached to one control panel 137, and control strings 150*a* and 150*b* may be attached to another control panel 141, while control panel 139 is not provided with any control strings.

The flying structure 130 can be folded and collapsed by folding and collapsing the frame member 132 and the sheet materials 134*a*, 134*b*, 142, 144 using the same method described in FIGS. 3A–3D. The smaller frame members 136, 138 and 140 can be folded and collapsed along with the folding and collapsing the frame member 132. If the control panels 137 and 141 are removably attached to the frame retaining sleeve of frame member 132, they can be detached therefrom prior to the folding and collapsing of the frame member 132 and the sheet materials 134*a*, 134*b*, and either folded and collapsed separately, or stacked on top of the frame members 132 and 138 to be folded and collapsed together. To open the flying structure 130 back to the expanded configuration, the collapsed frame member 132 is unfolded, and the springy nature and natural bias of the frame members 132 and 138 will cause the flying structure 130 to spring open to the expanded configuration. The control panels 137 and 141 can be re-attached if they have been previously detached.

Figure 8:
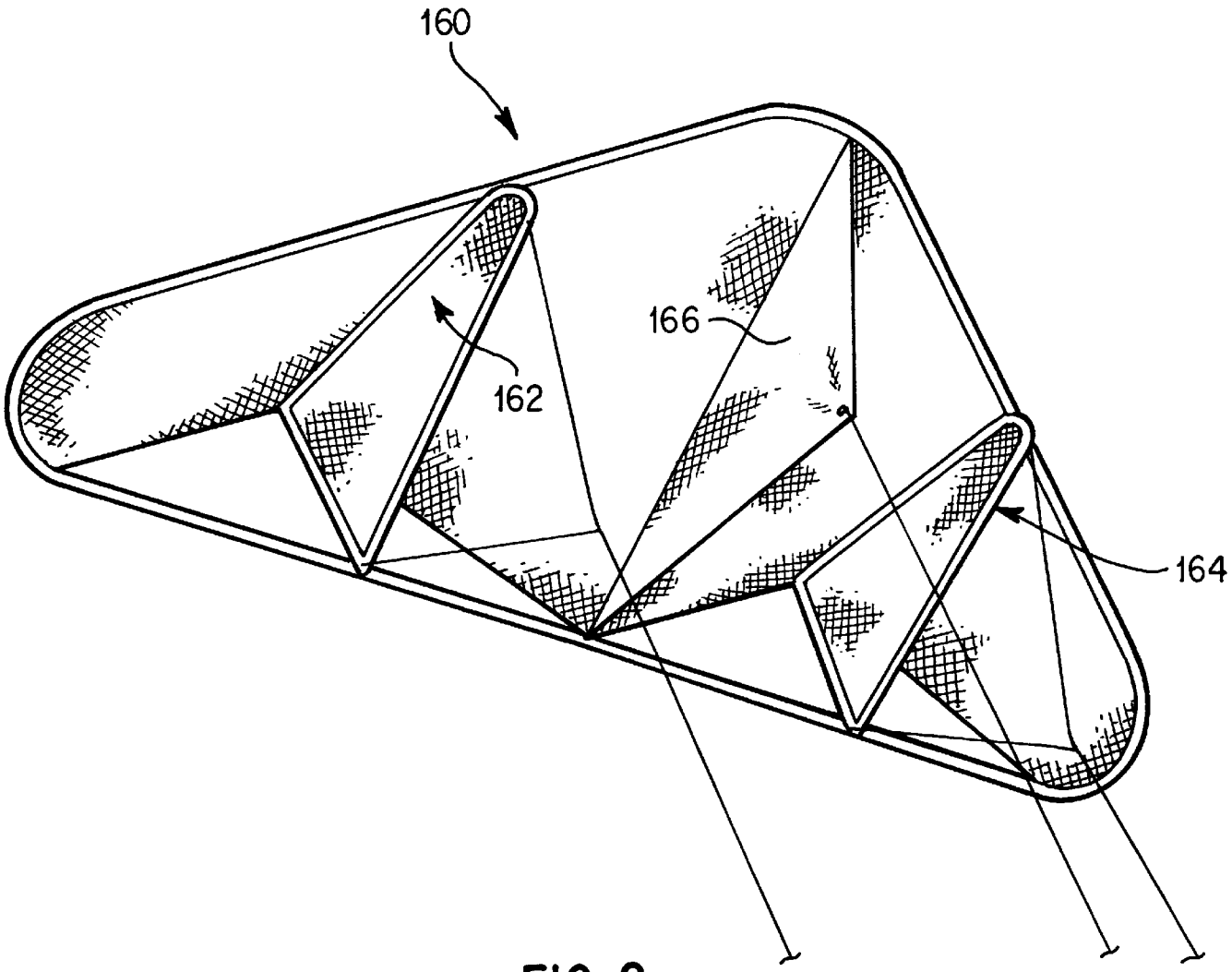
FIG. 8 is a perspective view of a collapsible flying structure according to a sixth preferred embodiment of the present invention shown in use in its expanded configuration.

It is also possible to provide some control panels with supporting frame members, and other control panels on the same flying structure without supporting frame members. For example, FIG. 8 illustrates a flying structure 160 that is similar in construction and operation to flying structures 60 and 130 of FIGS. 4 and 7, respectively. The flying structure 160 is provided with two control panels 162 and 164 which are supported with a frame member, and one control panel 166 which is not supported with a frame member.

Figure 9:
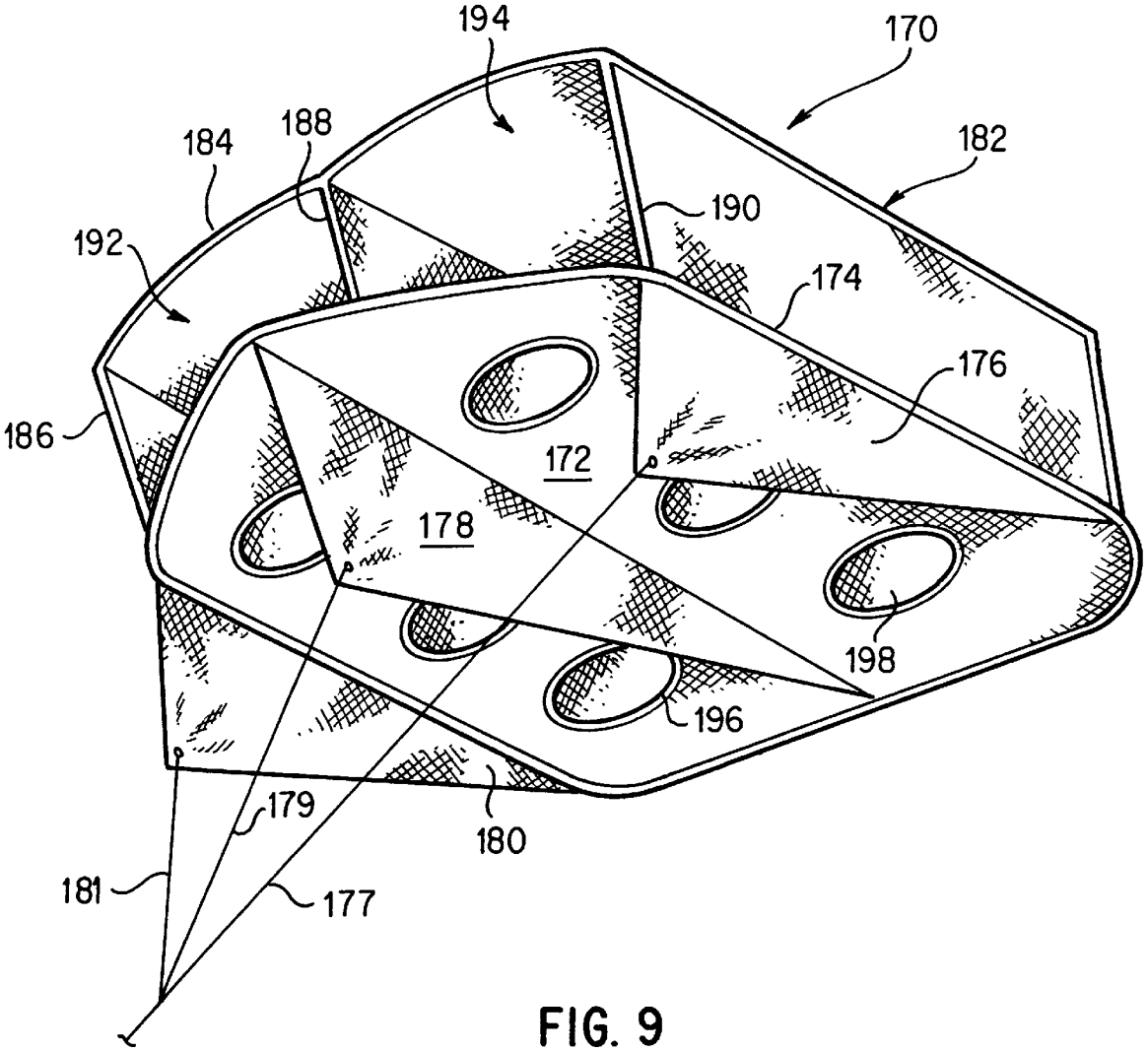
FIG. 9 is a perspective view of a collapsible flying structure according to a seventh preferred embodiment of the present invention shown in use in its expanded configuration.

FIG. 9 illustrates yet another flying structure 170 according to the present invention. The flying structure 170 is made up of a panel 172 having a continuous frame retaining sleeve 174 provided along and traversing its edges. A continuous frame member (not shown) is retained or held within the frame retaining sleeve 174 to support the panel 172. One side of the panel 172 is provided with three spaced-apart control panels 176, 178, 180. Although the control panels 176, 178, 180 are illustrated as not being supported by any frame members, it is also possible to provide frame members to support one or more of these control panels 176, 178, 180. Control strings 177, 179 and 181 are attached to the control panels 176, 178, 180, respectively.

A box-like enclosure 182 is attached to the side of the panel 172 opposite to that side which the control panels 176, 178, 180 are attached. The enclosure 182 is made of either a meshed material or one of the sheet materials used for the panel 22. The enclosure 182 has a bottom wall 184 and three side walls 186, 188 and 190 that define two separate compartments 192 and 194. The compartment 192 is defined by the side walls 186 and 188, the bottom wall 184, and the panel 172, while the compartment 194 is defined by the side walls 188 and 190, the bottom wall 184, and the panel 172. Thus, the central side wall 188 actually divides the enclosure 182 into the two compartments 192, 194. A first row of openings 196 are provided in the sheet material of the panel 172 along the first compartment 192 to allow air to flow into the first compartment 192. Similarly, a second row of openings 198 are provided in the sheet material of the panel 172 along the second compartment 194 to allow air to flow into the second compartment 194. Thus, air can be flowed into the compartments 192 and 194 during use to cause the flying structure 170 to get airborne and to float in the sky.

Those skilled in the art will appreciate that the dividing side wall 188 can be omitted so that only one compartment is provided in the enclosure 182.

To fold and collapse the flying structure 170, the walls 184, 186, 188 and 190 of the enclosure 182 are pressed against the panel 172. This can be easily accomplished because these walls 184, 186, 188 and 190 are made of a foldable and flexible material. The flying structure 170 can be twisted and folded according to the method illustrated in FIGS. 3A–3D to collapse the flying structure 170 into its collapsed configuration, with the walls 184, 186, 188 and 190 twisted and folded together with the panel 172.

To open the flying structure 170 back to the expanded configuration, the collapsed frame member and its panel 172 are unfolded, and the springy nature and natural bias of the frame member will cause the flying structure 170 to spring open to the expanded configuration. When the flying structure 170 is hoisted into the air, the wind will cause air to flow through the openings 196 and 198 into the compartments 192, 194, thereby forcing the bottom wall 184 away from the panel 172 to assume the configuration shown in FIG. 9.

Figure 10A:
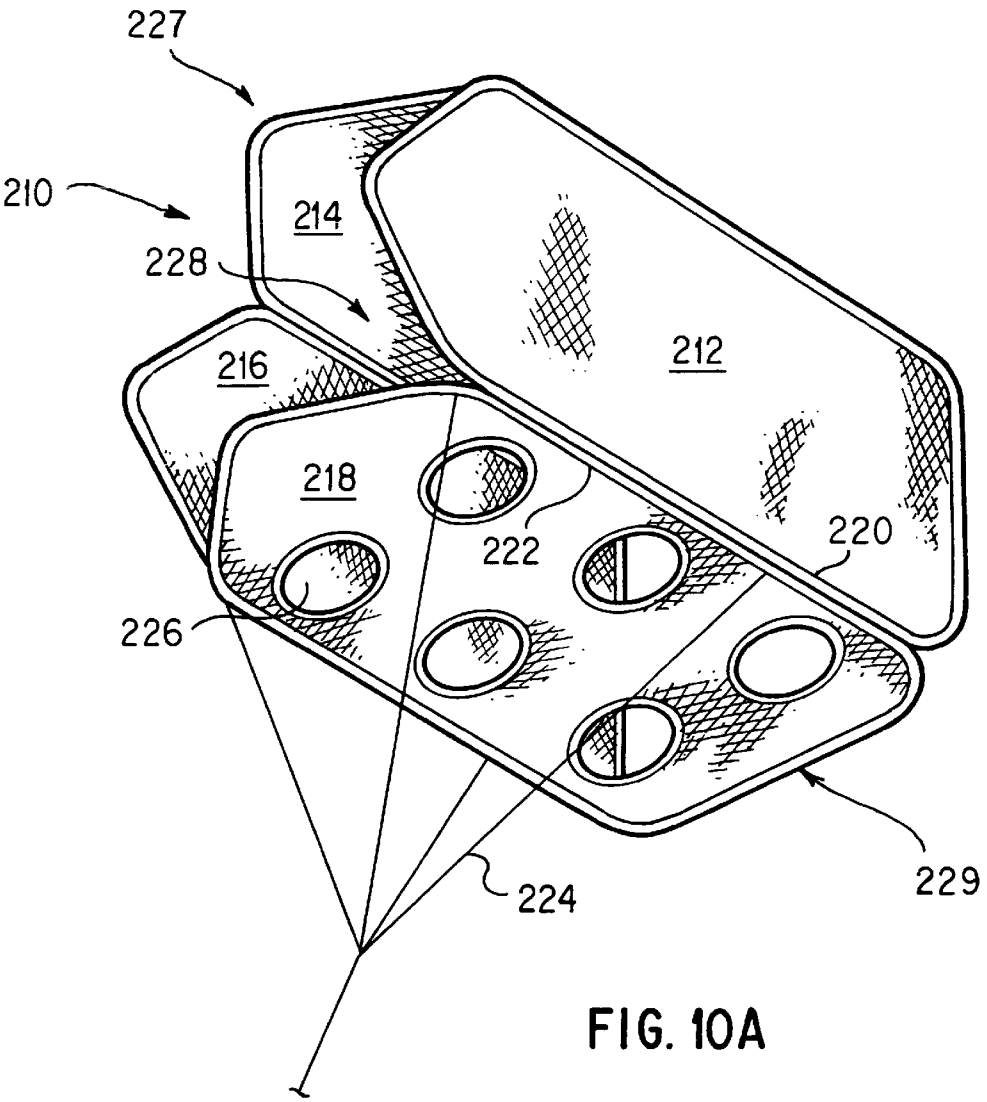
FIG. 10A is a perspective view of a collapsible flying structure according to a eighth preferred embodiment of the present invention shown in use in its expanded configuration.

FIG. 10A illustrates a flying structure 210 according to another embodiment of the present invention, which is made up of a plurality of panels, each having a supporting frame member. The flying structure 210 is made up of four panels 212, 214, 216 and 218, each having a supporting frame member. Each panel has two opposing straight sides, each of these straight sides being hingedly connected to an adjacent straight side of an adjacent panel to form an enclosed space 228. The flying structure 210 has opposing open ends 227, 229. The hinged connection can be a permanent connection, such as stitching the sides of two adjacent frame retaining sleeves (such as sleeves 220 and 222 of panels 212 and 218, respectively). Alternatively, the hinged connection can be a detachable connection, such as providing opposing Velcro™ pads, hooks, fasteners, buttons, snap-fit engagements, loops, snap buckles, zippers or ties along the sides of adjacent panels or frame retaining sleeves. A plurality of control strings 224 are attached to one panel, such as 218. A plurality of openings 226 are provided along the sheet material of one panel 218 to allow air to flow into the enclosed space 228. Thus, air can be flowed through the openings 226 or through the open ends 227, 229 into the enclosed space 228 during use to cause the flying structure 210 to get airborne and to float in the sky.

To fold and collapse the flying structure 210, the panels 212 and 214 may be pressed against the panels 218 and 216, respectively, about the respective hinged connections between the adjacent panels. The combined stack of panels 212 and 218 are then folded about the hinged connections onto the combined stack of panels 214 and 216 to form a stack of four panels 216, 214, 212 and 218 (in one possible order). The combined stack of panels 212, 214, 216 and 218 can then be folded and collapsed according to the method described above in FIGS. 3A–3D. Alternatively, if the hinged connections are detachable, it is also possible to separate one or more of the panels, and then place the separated panels one on top of the other so that the combined stack of panels 212, 214, 216, 218 can then be folded and collapsed according to the method described above in FIGS. 3A–3D.

To open and assemble the flying structure 210, the collapsed stack of panels 212, 214, 216, 218 is opened in the manner described above so that all the frame members are opened to their expanded configurations. The panels are then unfolded about the hinged connections to reach the configuration illustrated in FIG. 10A, where the flying structure 210 is ready for use. If the panels have been detached, they can then be re-attached to form the configuration illustrated in FIG. 10A.

Figure 10B:
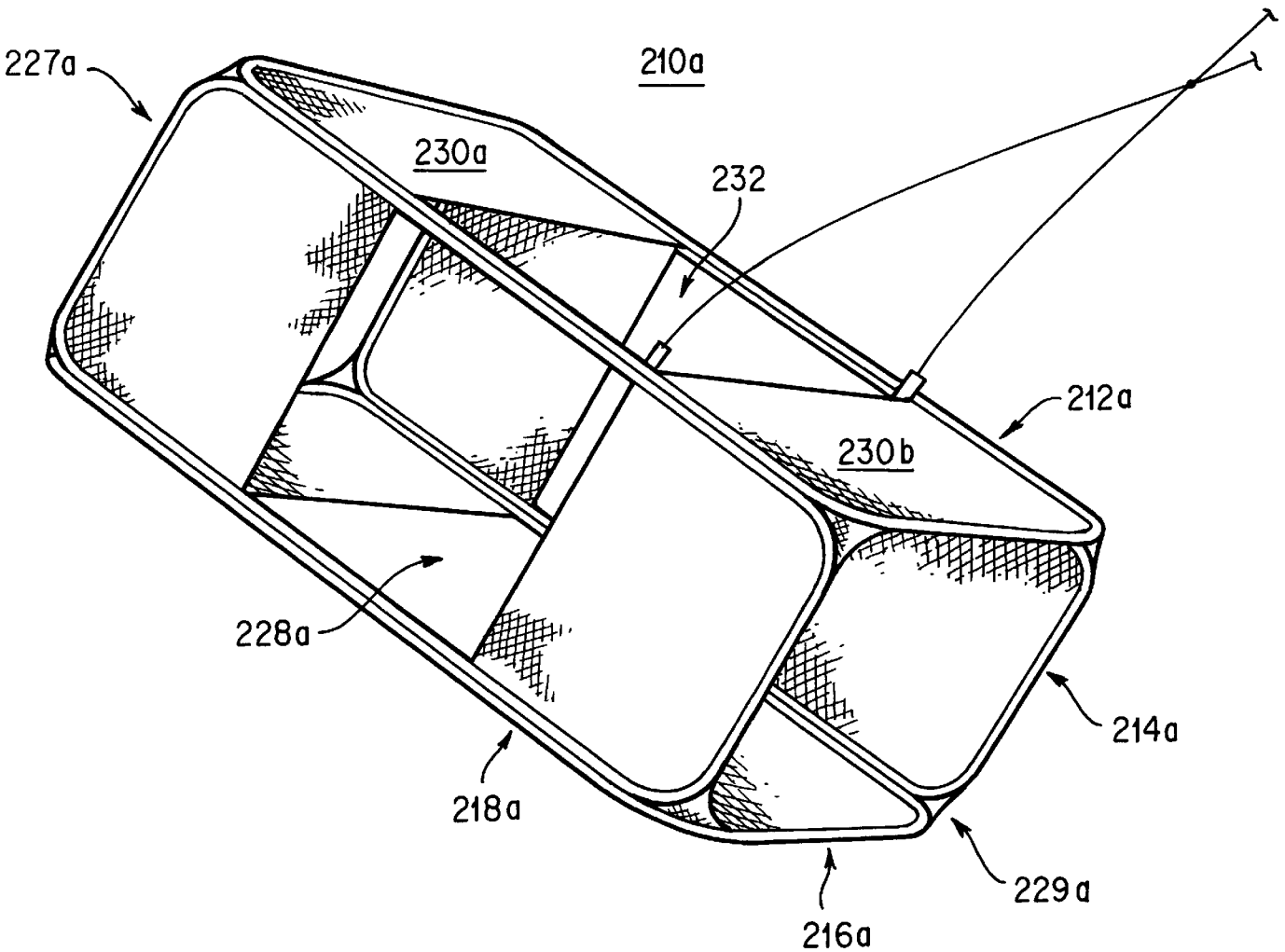
FIGS. 10B–10C are perspective views illustrating modifications to the collapsible flying structure of FIG. 10A.
Figure 10C:
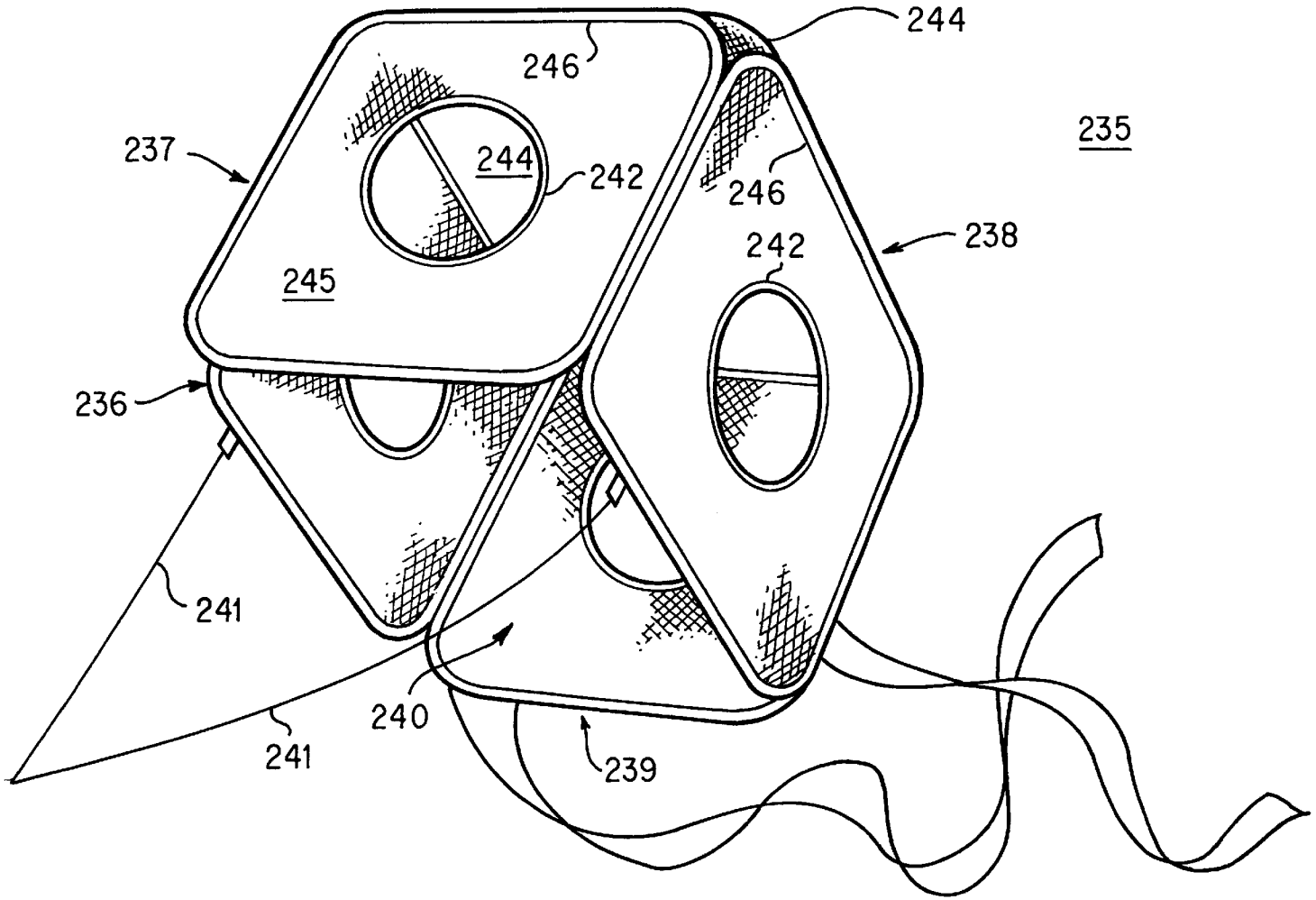

FIGS. 10B and 10C illustrate modifications that can be made to the flying structure 210 of FIG. 10A. For example, flying structure 210*a* in FIG. 10B has four generally rectangular panels 212*a*, 214*a*, 216*a* and 218*a*, each having a supporting frame member. Each panel has two opposing straight sides, each of these straight sides being hingedly connected to an adjacent straight side of an adjacent panel according to one of the methods described above for flying structure 210 to form an enclosed space 228*a*. The flying structure 210*a* has opposing open ends 227*a*, 229*a*. A primary distinction between flying structures 210 and 210*a* is that the sheet materials 230 in the panels 212*a*, 214*a*, 216*a* and 218*a* of flying structure 210*a* are divided so that each panel 212*a*, 214*a*, 216*a* and 218*a* has two separate pieces of sheet material 230*a* and 230*b*, defining a four-sided opening 232 therebetween. The flying structure 210*a* can be folded and collapsed, and opened and assembled, using the same procedure as for flying structure 210.

FIG. 10C illustrates a flying structure 235 having four generally square panels 236, 237, 238 and 239, each having a supporting frame member. Each panel has two opposing straight sides, each of these straight sides being hingedly connected to an adjacent straight side of an adjacent panel according to one of the methods described above for flying structure 210 to form an enclosed space 240. A plurality of control strings 241 are attached to two separate panels, such as 236 and 238. An openings 242 is provided in each panel 236, 237, 238, 239 to allow air to flow into the enclosed space 240. A primary distinction between flying structures 210 and 235 is that flying structure 235 has a piece of sheet material 244 (which can be the same material as the sheet material 245 of the panels 236, 237, 238, 239) attached to and extending between one side (e.g., see side 246) of each panel 236, 237, 238, 239 to form either a top, side or bottom wall. For example, the sheet material 245 can be stitched to the frame retaining sleeves of the panel 236, 237, 238, 239 along the side 246. The flying structure 235 can be folded and collapsed, and opened and assembled, using the same procedure as for flying structure 210, except that during the folding and collapsing, the sheet material 244 can be tucked between the two adjacent panels in the stack of panels.

Figure 11:
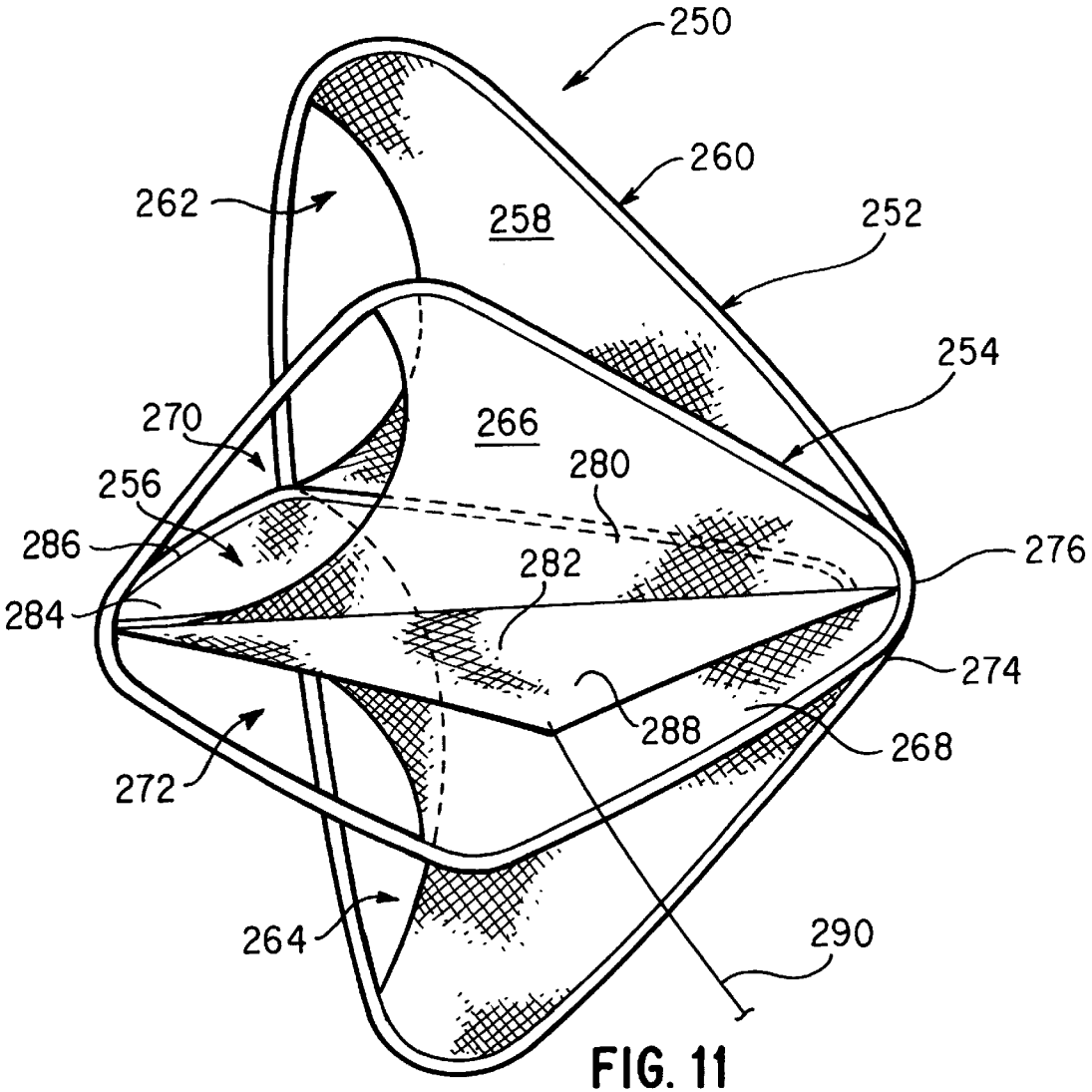
FIG. 11 is a perspective view of a collapsible flying structure according to a ninth preferred embodiment of the present invention shown in use in its expanded configuration.

FIG. 11 illustrates yet a further flying structure 250 according to the present invention. The flying structure 250 has two panels 252 and 254 separated by a supporting panel 256. A first panel 252 has a generally triangular configuration, and includes a continuous frame retaining sleeve 260 provided along and traversing most of the edges of the sheet material 258, except for two openings 262 and 264. The openings 262 and 264 are similar to openings 27, 29 in FIG. 1 and 133, 135 in FIG. 7 and perform the same functions. A continuous frame member (not shown) is retained or held within the frame retaining sleeve 260 to support the panel 252. A second panel 254 has a generally diamond-like configuration, and includes a continuous frame retaining sleeve 268 provided along and traversing most of the edges of the sheet material 266, again except for two openings 270 and 272. Another continuous frame member (not shown) is retained or held within the frame retaining sleeve 268 to support the panel 254. A corner 274 of the second panel 254 is hingedly connected to a corner 276 of the first panel 252, using one of the hinged connections described above.

A supporting panel 256 separates the first and second panels 252, 254. The supporting panel 256 has a generally triangular configuration with a first long side 280 (shown in phantom) and a second long side 282. Both the long sides 280 and 282 have an end that terminate at the connection at the corners 274, 276, and extend away from the corners 274, 276 at an angle with respect to each other. The supporting panel 256 also has a continuous frame retaining sleeve 286 provided along and traversing the edges of the sheet material 284, with a continuous frame member (not shown) retained or held within the frame retaining sleeve 286 to support the panel 256. The first long side 280 is connected to a central portion of the first panel 252 (such as along the sheet material 258), and the second long side 282 is connected to a central portion of the panel 254 (such as along the sheet material 266). At least one of the first or second long sides 280 or 282 is permanently and hingedly connected (such as by stitching) to the corresponding panel 252 or 254, respectively, with the other of the first or second long sides 280 or 282 being removably attached (using one of the removable connection mechanisms described above) to the other corresponding panel 252 or 254, respectively. In this embodiment, let us assume that the first long side 280 is permanently and hingedly connected to the panel 252, with the second long side 282 removably attached to the panel 254. It is also possible that both the first and second long sides 280, 282 are removably attached. Thus, the supporting panel 256 acts to separate the first and second panels 252, 254 at a predetermined distance and orientation from each other in a manner similar to the opening of the two shells of a clam. In this configuration, the supporting panel 256 is positioned generally perpendicular to the first and second panels 252 and 254.

In addition, a control panel 288 is attached to a side of the panel 254 opposite from the side to which the second long side 282 is connected. It is possible to provide the control panel 288 with a supporting frame member, or to omit the frame member. A control string 290 is attached to the control panel 288 for manipulation by the user.

To fold and collapse the flying structure 250, the connection between the panels 254 and 256 along the second long side 282 is first detached. The panel 256 is then folded against the panel 252 about the hinged connection of the first long side 280. Thereafter, the panel 254 is folded against the combined stack of panels 252 and 256 about the hinged connection at the corners 274, 276. The combined stack of panels 252, 254 and 256 can then be folded and collapsed according to the method described above in FIGS. 3A-3D.

Alternatively, if the first long side 280 is removably attached to the panel 252, with the second long side 282 permanently and hingedly connected to the panel 254, the connection between the panels 252 and 256 along the first long side 280 is first detached. The panel 256 is then folded against the panel 254 about the hinged connection of the second long side 282. Thereafter, the panel 252 is folded against the combined stack of panels 254 and 256 about the hinged connection at the corners 274, 276. The combined stack of panels 252, 254 and 256 can then be folded and collapsed according to the method described above in FIGS. 3A–3D.

As a further alternative, if both the first and second long sides 280, 282 are removably attached, it is possible to first completely detach the panel 256, then fold panel 254 onto panel 252, and place panel 256 onto the combined stack of panels 252, 254, before twisting and folding the combined stack of panels 252, 254 and 256 according to the method described above in FIGS. 3A–3D.

To open and assemble the flying structure 250, the collapsed stack of panels 252, 254, 256 is opened in the manner described above so that all the frame members are opened to their expanded configurations. The panels 252, 254 are unfolded about the hinged connection at corners 274, 276, and the removable attachments along either or both the first or second long side 280 or 282 are then re-attached to reach the configuration illustrated in FIG. 11, where the flying structure 250 is ready for use.

Figure 12:
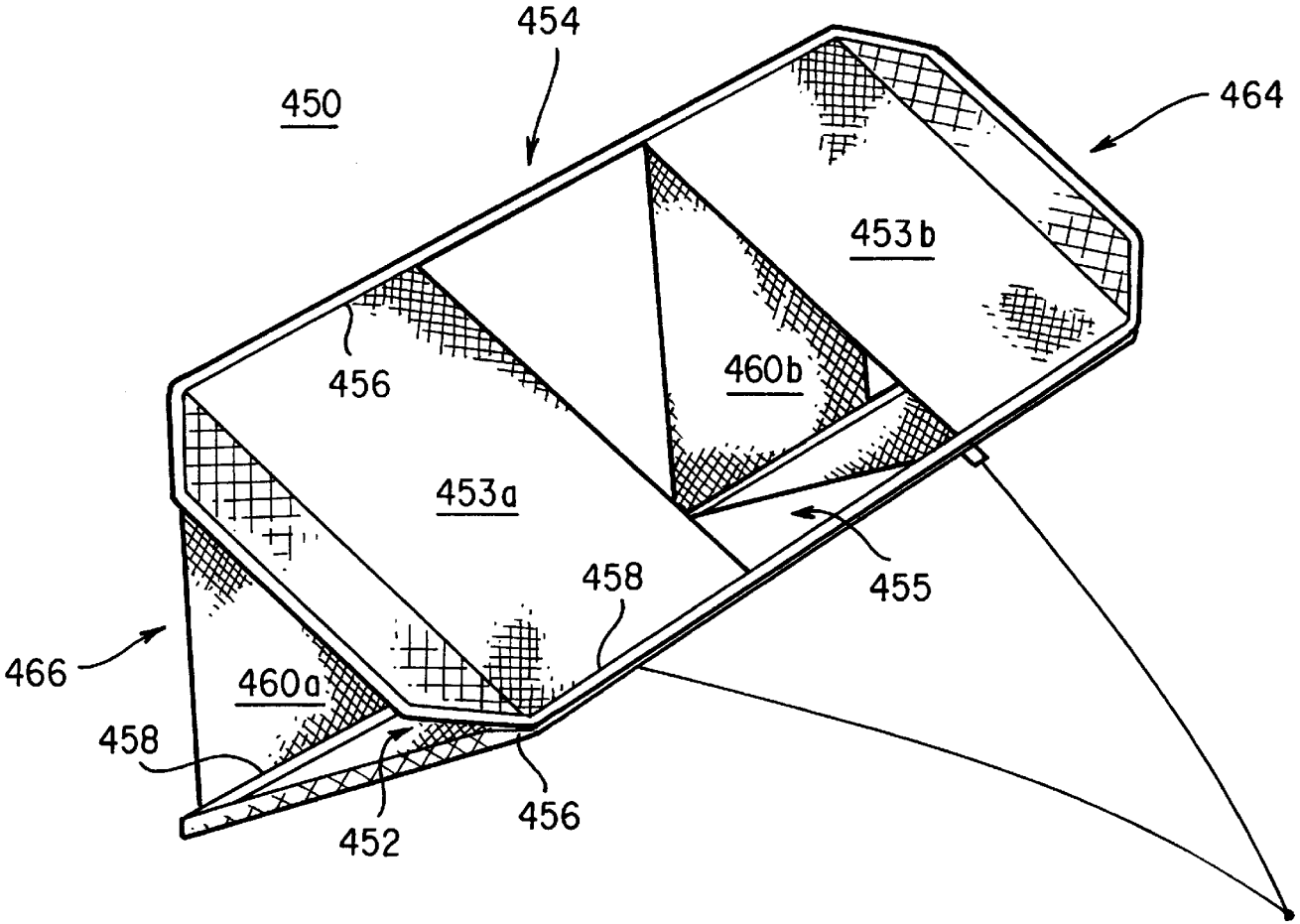
FIG. 12 is a perspective view of a collapsible flying structure according to a tenth preferred embodiment of the present invention shown in use in its expanded configuration.

FIG. 12 illustrates a flying structure 450 according to another embodiment of the present invention, which is made up of a plurality of panels, each having a supporting frame member. The flying structure 450 is made up of two panels 452 and 454, each having a supporting frame member. Each panel 452, 454 has two opposing straight sides 456 and 458, with one of the straight sides 456 of panel 452 hingedly connected to an adjacent straight side 458 of the adjacent panel 454 according to one of the methods described above for flying structure 210. Each panel 452, 454 also has two separated pieces of sheet material 453*a*, 453*b* (similar to flying structure 210*a* of FIG. 10B) with an opening 455 defined therebetween. In addition, a plurality of pieces of sheet material 460*a*, 460*b* is attached (e.g., by stitching) to the side 458 of panel 452 and the side 456 of panel 454 to form an enclosed space 462. The flying structure 450 has opposing open ends 464, 466. Control strings 468 can be attached to the hinged connection between the panels 452, 454.

To fold and collapse the flying structure 450, the panels 452, 454 may be pressed against each other about the hinged connection. The combined stack of panels 452, 454 can then be folded and collapsed according to the method described above in FIGS. 3A–3D. Alternatively, if the hinged connection between panels 452, 454 is provided as a removable attachment, it is also possible to separate the panels 452, 454, and then place the separated panels 452, 454 one on top of the other so that the combined stack of panels 452, 454 can then be folded and collapsed according to the method described above in FIGS. 3A–3D.

To open and assemble the flying structure 450, the collapsed stack of panels 452, 454 is opened in the manner described above so that all the frame members are opened to their expanded configurations. The panels are then unfolded about the hinged connection to reach the configuration illustrated in FIG. 12, where the flying structure 450 is ready for use. If the panels 452, 454 have been detached, they can then be reattached to form the configuration illustrated in FIG. 12.

It is possible to modify the flying structure 450 so that the sheet materials 460*a*, 460*b* are replaced by a third panel that has the same structure as panels 452, 454. The third panel has two opposing straight sides, with one such opposing straight side connected to the side 458 of panel 452, and the other such opposing straight side connected to side 456 of panel 454. At least one of the two straight sides of the third panel must be removably connected to either the side 456 of panel 454 or the side 458 of panel 452 using one of the removable connection mechanisms described above, so that the flying structure 450 can be folded and collapsed.

In particular, if both straight sides of the third panel are removably connected to the panels 452 and 454, then to fold and collapse the flying structure 450, the removable connections can be detached to remove the third panel, which can then be placed on top of the stack of panels 452, 454, with the combined stack of the panels 452, 454 and the third panel folded and collapsed according to the method described above in FIGS. 3A–3D. Alternatively if one straight side of the third panel is removably connected to the panel 452 and the opposing straight side is hingedly connected to the panel 454, then to fold and collapse the flying structure 450, the removable connection can be detached, and the third panel folded about its hinged connection with panel 454, and the panel 452 folded about its hinged connection with panel 454, to create a stack of three panels, with the combined stack of the panels 452, 454 and the third panel folded and collapsed according to the method described above in FIGS. 3A–3D. This variation of the flying structure 450 can be opened and assembled by opening the collapsed stack of panels in the manner described above so that all the frame members are opened to their expanded configurations. The panels are then unfolded about the hinged connection to reach the configuration illustrated in FIG. 12, where the flying structure 450 is ready for use. If the third panel has been detached, it can then be removably re-attached to form the configuration illustrated in FIG. 12.

Although the various embodiments of the present invention have been illustrated as having one or more control panels, these control panels can be omitted, with the control strings directly attached to these panels of the flying structures to control the flight of the various flying structures. Each of these control panels can be provided with or without supporting frame members.

In addition, although the frame members and panels of the various embodiments are described hereinabove as having specific configurations, it is possible to provide these frame members and panels in any shape or size, and to vary the shapes and sizes of the panels of a particular flying structure.

Thus, the flying structures according to the present invention may be provided in a variety of configurations in which the number of basic structures and the shape and size of the separate panels may be varied. Some of the flying structures of the present invention can even be disassembled to create a plurality of different flying structures. These features add variety and entertainment value. The flying structures according to the present invention can be easily deployed and disassembled, and are easy to fold and collapse into a compact configuration for convenient storage and transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A flying structure, comprising:

first and second structures, each of the first and second structures comprising:

an enclosed resilient frame member having a folded and an unfolded orientation, the frame member being coilable and having a natural bias which biases it to the unfolded orientation; and a sheet material partially covering the resilient frame member when the frame member is in the unfolded orientation;

a connector having a first end attached to the first structure and a second end attached to the second structure; and wherein the first structure may be placed on top of the second structure when their frame members are in the unfolded orientation to form a stack of first and second structures, and wherein frame members of the stack of first and second structures may be twisted and folded to form a plurality of concentric loops in the folded orientation of the frame members to substantially reduce the sizes of the first and second structures, with the natural bias operating to cause the frame member to spring open to the unfolded orientation when the frame member is unfolded from the folded orientation.

2. The flying structure of claim 1, wherein the connector is detachable so that the first and second structures can be separated.

3. The flying structure of claim 1, wherein the first and second ends of the connector are attached to the sheet materials of the first and second structures, respectively.

4. The flying structure of claim 1, further including a second connector for connecting the first and second structures.

5. The flying structure of claim 1, wherein each of the first and second structures further includes a frame retaining sleeve for housing the frame member, with the sheet material attached to the frame retaining sleeve.

6. The flying structure of claim 1, wherein the connector operates as a hinge to allow the first structure to be folded upon the second structure about the connector.

7. The flying structure of claim 1, wherein the first and second structures each further includes a control panel attached thereto.

8. The flying structure of claim 1, further including a control string coupled to one of the first and second structures for controlling the flight of the flying structure.

9. The flying structure of claim 1, further including at least one opening defined between each sheet material and frame member.

10. The flying structure of claim 1, further including a third structure, the third structure comprising:

an enclosed resilient frame member having a folded and an unfolded orientation; and a sheet material partially covering the resilient frame member when the frame member is in the unfolded orientation; and wherein the flying structure further includes a second connector for connecting the second and third structures.

11. The flying structure of claim 10, further including a third connector for connecting the first and second structures.

12. The flying structure of claim 11, further including a fourth connector for connecting the second and third structures.

13. A flying structure, comprising:

first and second structures, each of the first and second structures comprising:

an enclosed resilient frame member having a folded and an unfolded orientation, the frame member being coilable and having a natural bias which biases it to the unfolded orientation;

a sheet material partially covering the resilient frame member when the frame member is in the unfolded orientation; and a first side and a second side;

with the first side of the first structure connected to the second side of the second structure; and wherein the first structure may be placed on top of the second structure when their frame members are in the unfolded orientation to form a stack of first and second structures, and wherein frame members of the stack of first and second structures may be twisted and folded to form a plurality of concentric loops in the folded orientation of the frame members to substantially reduce the sizes of the first and second structures, with the natural bias operating to cause the frame member to spring open to the unfolded orientation when the frame member is unfolded from the folded orientation.

14. The flying structure of claim 13, wherein the first side of the first structure is stitched to the second side of the second structure to form a hinged connection.

15. The flying structure of claim 13, wherein the flying structure further includes a sheet material connected to the first side of the second structure and the second side of the first structure.

16. A flying structure, comprising:

at least first, second and third structures, each of the first, second and third structures comprising:

an enclosed resilient frame member having a folded and an unfolded orientation;

a sheet material partially covering the resilient frame member when the frame member is in the unfolded orientation; and a first side and a second side;

wherein the first side of each of the structures is connected with the second side of another of the structures so that all the structures are connected together to form an enclosed space; and wherein each structure may be placed on top of another structure when their frame members are in the unfolded orientation to form a stack of structures, and wherein frame members of the stack of structures may be twisted and folded to form a plurality of concentric loops in the folded orientation of the frame members, to substantially reduce the sizes of the structures.

17. The flying structure of claim 16, wherein at least one opening is provided in the sheet material of one of the structures to communicate air to the enclosed space.

18. The flying structure of claim 16, further comprising a fourth structure having:

an enclosed resilient frame member having a folded and an unfolded orientation;

a sheet material partially covering the resilient frame member when the frame member is in the unfolded orientation; and a first side and a second side;

wherein the first side of the fourth structure is connected with the second side of the first structure, and the second side of the fourth structure is connected with the first side of the third structure, so that all the structures are connected together to form an enclosed space.

19. The flying structure of claim 18, wherein each of the four structures has a third side, and wherein the flying structure has a sheet material that is attached to and extends between the third side of each structure.

20. The flying structure of claim 16, wherein the first side of the first structure is hingedly connected to the second side of the second structure, and the second side of the first structure is removably connected to the first side of the third structure.

21. A flying structure, comprising:

an enclosed resilient frame member having a folded and an unfolded orientation, the frame member being coilable and having a natural bias which biases it to the unfolded orientation;

a sheet material covering a portion of the resilient frame member to form the flying structure when the frame member is in the unfolded orientation, the sheet material having at least one opening; and a control string coupled to the sheet material for controlling the flight of the flying structure;

wherein the frame member may be twisted and folded to form a plurality of concentric loops in the folded orientation of the frame member to substantially reduce the size of the flying structure, with the natural bias operating to cause the frame member to spring open to the unfolded orientation when the frame member is unfolded from the folded orientation.

22. The structure of claim 21, further including at least one control panel attached to the panel and coupling the control string with the panel.

23. The structure of claim 22, wherein one of the at least one control panels includes an enclosed resilient frame member having a folded and an unfolded orientation, with the control panel substantially covering the resilient frame member when the frame member is in the unfolded orientation.

24. The structure of claim 21, further including a frame retaining sleeve for housing the frame member, with the panel attached to the frame retaining sleeve.

25. The structure of claim 21, wherein the at least one opening is defined between the panel and the frame member.

26. The structure of claim 21, wherein the frame member may be repeatedly folded to the folded orientation and then subsequently unfolded to the unfolded orientation.

* * * * *